US008018450B2

(12) United States Patent
Kimura et al.

(10) Patent No.: US 8,018,450 B2
(45) Date of Patent: Sep. 13, 2011

(54) ELECTROOPTIC DEVICE, DRIVING CIRCUIT, AND ELECTRONIC DEVICE

(75) Inventors: Fusashi Kimura, Matsumoto (JP); Masaki Takahashi, Shiojiri (JP); Atsunari Tsuda, Suwa (JP)

(73) Assignee: Epson Imaging Devices Corporation, Azumino-shi (JP)

( * ) Notice: Subject to any disclaimer, the term of this patent is extended or adjusted under 35 U.S.C. 154(b) by 1236 days.

(21) Appl. No.: 11/650,999

(22) Filed: Jan. 9, 2007

(65) Prior Publication Data

US 2007/0188439 A1 Aug. 16, 2007

(30) Foreign Application Priority Data

Feb. 16, 2006 (JP) ..... 2006-039203

(51) Int. Cl.
*G09G 5/00* (2006.01)

(52) U.S. Cl. ..... 345/207; 345/76; 345/82; 345/102

(58) Field of Classification Search ..... 345/76, 345/82, 102, 207
See application file for complete search history.

(56) References Cited

U.S. PATENT DOCUMENTS

| | | | | |
|---|---|---|---|---|
| 6,556,258 | B1 * | 4/2003 | Yoshida et al. | 349/61 |
| 7,595,784 | B2 | 9/2009 | Yamamoto et al. | |
| 2003/0052869 | A1 * | 3/2003 | Fujii et al. | 345/204 |
| 2003/0067435 | A1 * | 4/2003 | Liu | 345/101 |
| 2005/0285996 | A1 * | 12/2005 | Nakamura et al. | 349/106 |
| 2007/0075935 | A1 * | 4/2007 | Mesmer et al. | 345/76 |

FOREIGN PATENT DOCUMENTS

| | | |
|---|---|---|
| JP | A 6-18880 | 1/1994 |
| JP | U 6-28881 | 4/1994 |
| JP | A 11-295692 | 10/1999 |
| JP | A 2000-193936 | 7/2000 |
| JP | A-2003-280598 | 10/2003 |
| JP | A 2005-121997 | 5/2005 |
| JP | A 2005-258404 | 9/2005 |
| KR | 10 2003 0038897 A | 5/2003 |

* cited by examiner

*Primary Examiner* — Richard Hjerpe
*Assistant Examiner* — Saifeldin Elnafia
(74) *Attorney, Agent, or Firm* — Oliff & Berridge, PLC

(57) ABSTRACT

An electrooptic device includes a display panel; an illuminating unit; an ambient-light measuring unit; a luminance control unit; a display-mode switching unit; and a storage unit, wherein when the display panel is switched to the transmission display mode by the display-mode switching unit, the gamma value for the transmission display is obtained from the plurality of tables stored in the storage unit, and the gamma value for the transmission display is applied; and when the display panel is switched to the reflection display mode by the display-mode switching unit, the gamma value for the reflection display is obtained from the plurality of tables stored in the storage unit, and the gamma value for the reflection display is applied.

13 Claims, 12 Drawing Sheets

ELECTROOPTIC DEVICE, DRIVING CIRCUIT, AND ELECTRONIC DEVICE

The entire disclosure of Japanese Patent Application No. 2006-039203, filed Feb. 16, 2006 is expressly incorporated by reference herein.

BACKGROUND

1. Technical Field

The present invention relates to electrooptic devices suitable for use in displaying various information.

2. Related Art

General liquid crystal devices have an illuminating unit on the back of a liquid-crystal display panel for transmission display. The general liquid crystal devices have used a constant-intensity light source both in light places and in dark places irrespective of extraneous light.

However, humans feel even low-luminance light bright because the pupils of humans' visual sense dilate in dark places. Nevertheless, illuminating units illuminate the liquid-crystal display panel at constant luminance all the time. Accordingly, humans feel the illumination too bright in dark places to see the display screen. Moreover, illuminating units use the same constant-luminance light source as that for dark places even in very light places where the luminance of the reflected light is higher than that of transmitted light, causing wasteful power consumption.

JP-A-2005-121997 discloses a method for controlling the backlight of a liquid-crystal display device in which the backlight is automatically controlled only when the illuminance around the liquid-crystal display panel changes evenly. JP-A-6-18880 and JP-A-6-28881 disclose liquid crystal displays in which the illuminance of the display screen is automatically controlled according to a light control profile on the basis of the illuminance of ambient light sensed.

However, the above-mentioned JP-A-2005-121997 describes merely a method for automatically controlling the back light. This method has the problem that if the method is applied to a liquid crystal device having multicolor filters equipped with a backlight, it is impossible to automatically control the backlight in consideration of contrast and color matching.

JP-A-6-18880 and JP-A-6-28881 have the problem that the light control profile is not suitable for humans' visual sense.

SUMMARY

An advantage of some aspects of the invention is to provide a method for automatically controlling the light of the illuminating unit of electrooptic devices in which display quality such as contrast, color matching, and brightness can be improved with reduced power consumption.

According to an aspect of the invention, there is provided an electrooptic device comprising: a display panel; an illuminating unit that emits light onto the display panel; an ambient-light measuring unit that measures the illuminance of ambient light; a luminance control unit including a light control profile for obtaining the optimum surface luminance of the display panel, the luminance control unit obtaining the optimum surface luminance on the basis of the measured illuminance of the ambient light using the light control profile, and controlling the luminance of the light to be emitted from the illuminating unit to provide the display panel with the optimum surface luminance; a display-mode switching unit that switches the display panel to a transmission display mode when the illuminance of the ambient light measured by the ambient-light measuring unit is lower than a predetermined illuminance, and switches the display panel to a reflection display mode when the illuminance of the ambient light is higher than the predetermined illuminance; and a storage unit that stores a gamma value for the transmission display for the transmission display mode and a gamma value for the reflection display for the reflection display mode as a plurality of tables. When the display panel is switched to the transmission display mode by the display-mode switching unit, the gamma value for the transmission display is obtained from the plurality of tables stored in the storage unit, and the gamma value for the transmission display is applied. When the display panel is switched to the reflection display mode by the display-mode switching unit, the gamma value for the reflection display is obtained from the plurality of tables stored in the storage unit, and the gamma value for the reflection display is applied.

The electrooptic device is, for example, a liquid crystal device, which includes a display panel; an illuminating unit that emits light onto the display panel; an ambient-light measuring unit; a luminance control unit; a display-mode switching unit; and a storage unit. The ambient-light measuring unit is, for example, a photosensor, which measures the illuminance of the ambient light. The luminance control unit is, for example, a control circuit. The luminance control unit obtains the optimum surface luminance on the basis of the measured illuminance of the ambient light using the light control profile, and controls the luminance of the light to be emitted from the illuminating unit to provide the display panel with the optimum surface luminance.

The display-mode switching unit switches the display panel to a transmission display mode in which transmission display is performed through the illuminating unit when the illuminance of the ambient light measured by the ambient-light measuring unit is lower than a predetermined illuminance, and switches the display panel to a reflection display mode in which reflection display is performed through the extraneous light when the illuminance of the ambient light measured by the ambient-light measuring unit is higher than the predetermined illuminance. Preferably, when the illuminance of the ambient light measured by the ambient-light measuring unit is 1,000 lx or lower, the display-mode switching unit switches the display panel to the transmission display mode, and when the illuminance of the ambient light is higher than 1,000 lx, the display-mode switching unit switches the display panel to the reflection display mode; and the predetermined illuminance is 1,000 lx.

The storage unit stores a plurality of tables listing a gamma value 1.8 for transmission display corresponding to the transmission display mode and a gamma value 2.2 for reflection display corresponding to the reflection display mode in a general expression $L=KE^{\gamma}$ where L is the optimum surface luminance of the display panel, K is a constant, $\gamma$ is the gamma value, and E is a driving voltage for the display panel. This is because the reflecting color filter is often lighter in color (more whitish) than the transmitting color filter.

Particularly, in this electrooptic device, when the display mode is switched to the transmission display mode by the display-mode switching unit, the gamma value for the transmission display is obtained from the tables stored in the storage unit and the gamma value for the transmission display is applied; when the display mode is switched to the reflection display mode by the display-mode switching unit, the gamma value for the reflection display is obtained from the tables stored in the storage unit and the gamma value for the reflection display is applied. Accordingly, the surface luminance of the display panel can be appropriately controlled to the transmission display mode or the reflection display mode by making known gamma correction based on the gamma value.

In summary, the electrooptic device is subjected to automatic light control for the illuminating unit by the luminance control unit, so that it is provided with the optimum surface luminance which is suitable for humans' visual sense according to the illuminance of the ambient light. Moreover, the display-mode switching unit switches the display panel between the transmission display mode and the reflection display mode according to the illuminance of the ambient light, and then the gamma value for the transmission display or the gamma value for the reflection display is applied correspondingly, so that the luminance of the display panel can be controlled appropriately. Consequently, the display quality can be improved while the power consumption of the illuminating unit is reduced.

Preferably, the light control profile is plotted as an approximate curve based on experimental results, which has the relationship in which the optimum surface luminance forms a concave quadratic curve with respect to the logarithm of the illuminance of the ambient light, and provided that the illuminance of the ambient light when the luminance of the light incident on the display panel and reflected in the display panel and exits from the display panel and the luminance of the light emitted from the illuminating unit and transmitted through the display panel are equal to each other is the maximum illuminance environment, the optimum surface luminance can be the maximum under the maximum illuminance environment, and the maximum value of the optimum surface luminance can be 90% or more of the maximum luminance of the display panel. Since the optimum surface luminance is obtained from the illuminance of the ambient light using the light control profile, the display panel can be illuminated at a brightness suitable for humans' visual sense.

Preferably, the storage unit includes a plurality of tables in which the relationship between the logarithm of the illuminance of the ambient light and the contrast of the display panel is stored for each luminance of the light of the illuminating unit; and the luminance control unit obtains a table for setting the display panel to a predetermined contrast from the plurality of tables stored in the storage unit so as to provide the display panel with the predetermined contrast, and controls the luminance of the light of the illuminating unit according to the table.

In this case, the storage unit includes a plurality of tables in which the relationship between the logarithm of the illuminance of the ambient light and the contrast of the display panel is stored for each luminance of the light of the illuminating unit. The luminance control unit obtains a table for setting the display panel to a predetermined contrast from the plurality of tables stored in the storage unit so as to provide the display panel with the predetermined contrast, and controls the luminance of the light of the illuminating unit according to the table. Thus, even if the ambient light changes, the contrast can be constantly maintained at the predetermined value.

Preferably, the storage unit has a plurality of tables in which the relationship between the logarithm of the illuminance of the ambient light and the color reproduction range based on an NTSC standard ratio of the display panel is stored for each luminance of the light of the illuminating unit; and the luminance control unit obtains a table for setting the display panel to a predetermined color reproduction range based on a National Television System Committee (NTSC) standard ratio from the plurality of tables stored in the storage unit so as to provide the display panel with the color reproduction range based on the NTSC standard ratio, and controls the luminance of the light of the illuminating unit according to the table.

In this case, the storage unit includes a plurality of tables in which the relationship between the logarithm of the illuminance of the ambient light and the color reproduction range based on an NTSC standard ratio of the display panel is stored for each luminance of the light from the illuminating unit. The color reproduction range of a display panel is expressed as an area ratio of the triangle formed by red (0.670, 0.330), green (0.210, 0.710), and blue (0.140, 0.080) in the chromaticity coordinates (x, y) in a chromaticity diagram of an XYZ color system to the NTSC standard. For example, the color reproduction range of the display panel is expressed as an NTSC standard ratio of 90%. The luminance control unit acquires a table for setting the color reproduction range of the display panel to a color reproduction range based on the NTSC standard ratio, e.g., 90%, from the tables stored in the storage unit so as to bring the color reproduction range of the display panel to a color reproduction range based on the NTSC standard ratio, e.g., 90%, and controls the luminance of the light of the illuminating unit on the basis of the table. Thus, even if the illuminance of the ambient light changes, the color reproduction range of the display panel can be kept in the color reproduction range based on a predetermined NTSC standard ratio, e.g., 90%.

Preferably, the illuminating unit includes a plurality of light sources having semiconductor light-emitting elements that emit three or more colors of light, respectively; the electrooptic device further includes a photosensor disposed in the position to detect mixed light generated by the plurality of light sources of the illuminating unit, the photosensor detecting the mixed light and conducting spectral analysis of it to thereby calculate the luminances of the light sources; and the luminance control unit includes a driving unit that supplies current to the plurality of light sources, and regulates the white balance of the display panel by controlling the current to be supplied to a light source that emits a predetermined color of light out of the light sources.

In this case, the illuminating unit includes a plurality of light sources having semiconductor light-emitting elements that emit three or more colors of light, e.g., red (R), green (G), and blue (B), respectively. Here, the semiconductor light-emitting device is a light-emitting diode (LED). The electrooptic device further includes a photosensor disposed in the position to detect mixed light generated by the plurality of light sources in the illuminating unit, the photosensor detecting the mixed light and conducting spectral analysis of it to thereby calculate the luminances of the light sources.

However, aged deterioration varies among the RGB LEDs. Therefore, even if appropriate currents are applied to maintain specified white balance, the white balance will be lost with aged deterioration.

In this respect, the luminance control unit includes a driving unit that supplies current to the plurality of light sources, and controls the white balance of the display panel by controlling the current to be supplied to a light source that emits a predetermined color of light out of the light sources according to the calculated luminances of the light sources. This allows the white balance to be kept constant, thus enhancing the color reproducibility.

Preferably, the maximum value of the optimum surface luminance is the maximum luminance of the display panel.

Preferably, provided that the illuminance of the ambient light when the luminances of the reflected light and transmitted light from the display panel are equal to each other is 8,000 lx or higher, the maximum illuminance environment is set to 8,000 lx. This allows the luminance of the display screen to be agreed to the maximum luminance when the ambient light around the display screen is at the possible highest illuminance irrespective of whether the liquid crystal device is of a complete transmission type or a semitransmitting reflection type.

Preferably, when the illuminance of the ambient light measured by the ambient-light measuring unit becomes higher than the maximum illuminance environment, the luminance control unit stops the light emission to the display panel by the illuminating unit. Thus, the luminance of the display screen becomes 0 $cd \cdot m^{-2}$, allowing the power saving of the illuminating unit.

According to a second aspect of the invention, there is provided an electronic device including the electrooptic device as a display.

Preferably, the electronic device comprises: a light-emitting section other than the illuminating unit (e.g., an on/off power switch for personal computers, and luminous operation buttons for mobile phones). The luminance control unit has a light control profile for obtaining the optimum surface luminance of the light-emitting section, the luminance control unit obtaining the optimum surface luminance on the basis of the illuminance of the ambient light measured by the ambient-light measuring unit using the light control profile, and controlling the luminance of the light-emitting section to provide the light-emitting section with the optimum surface luminance. Since the optimum surface luminance is obtained from the illuminance of the ambient light using the light control profile, the light-emitting section can be illuminated at an brightness suitable for humans' visual sense, and moreover, the power saving of the light-emitting section can be achieved.

According to a third aspect of the invention, there is provided a driving circuit that automatically controls the light of an illuminating unit that emits light onto a display panel. The driving circuit comprises: an ambient-light measuring unit that measures the illuminance of ambient light; luminance control unit including a light control profile for obtaining the optimum surface luminance of the display panel, the luminance control unit obtaining the optimum surface luminance on the basis of the measured illuminance of the ambient light using the light control profile, and controlling the luminance of the illuminating unit to provide the display panel with the optimum surface luminance; display-mode switching unit that switches the display panel to a transmission display mode when the illuminance of the ambient light measured by the ambient-light measuring unit is lower than a predetermined illuminance, and switches the display panel to a reflection display mode when the illuminance of the ambient light is higher than the predetermined illuminance; and a storage unit that stores a gamma value for the transmission display for the transmission display mode and a gamma value for the reflection display for the reflection display mode as a plurality of tables. When the display panel is switched to the transmission display mode by the display-mode switching unit, the gamma value for the transmission display is obtained from the plurality of tables stored in the storage unit, and the gamma value for the transmission display is applied. When the display panel is switched to the reflection display mode by the display-mode switching unit, the gamma value for the reflection display is obtained from the plurality of tables stored in the storage unit, and the gamma value for the reflection display is applied.

Thus, the driving circuit is allowed to automatically control the light of the illuminating unit by the light control unit, thereby providing the optimum surface luminance suitable for humans' visual sense. Moreover, the display-mode switching unit switches the display panel between the transmission display mode and the reflection display mode according to the illuminance of the ambient light, and then the gamma value for the transmission display or the gamma value for the reflection display is applied correspondingly, so that the luminance of the display panel can be controlled appropriately. Consequently, the display quality can be improved while the power consumption of the illuminating unit is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Preferred embodiments of the invention will be described with reference to the drawings. The embodiments are applications of the invention to a liquid crystal device as an example of electrooptic devices.

Structure of Liquid Crystal Device

Figure 1:
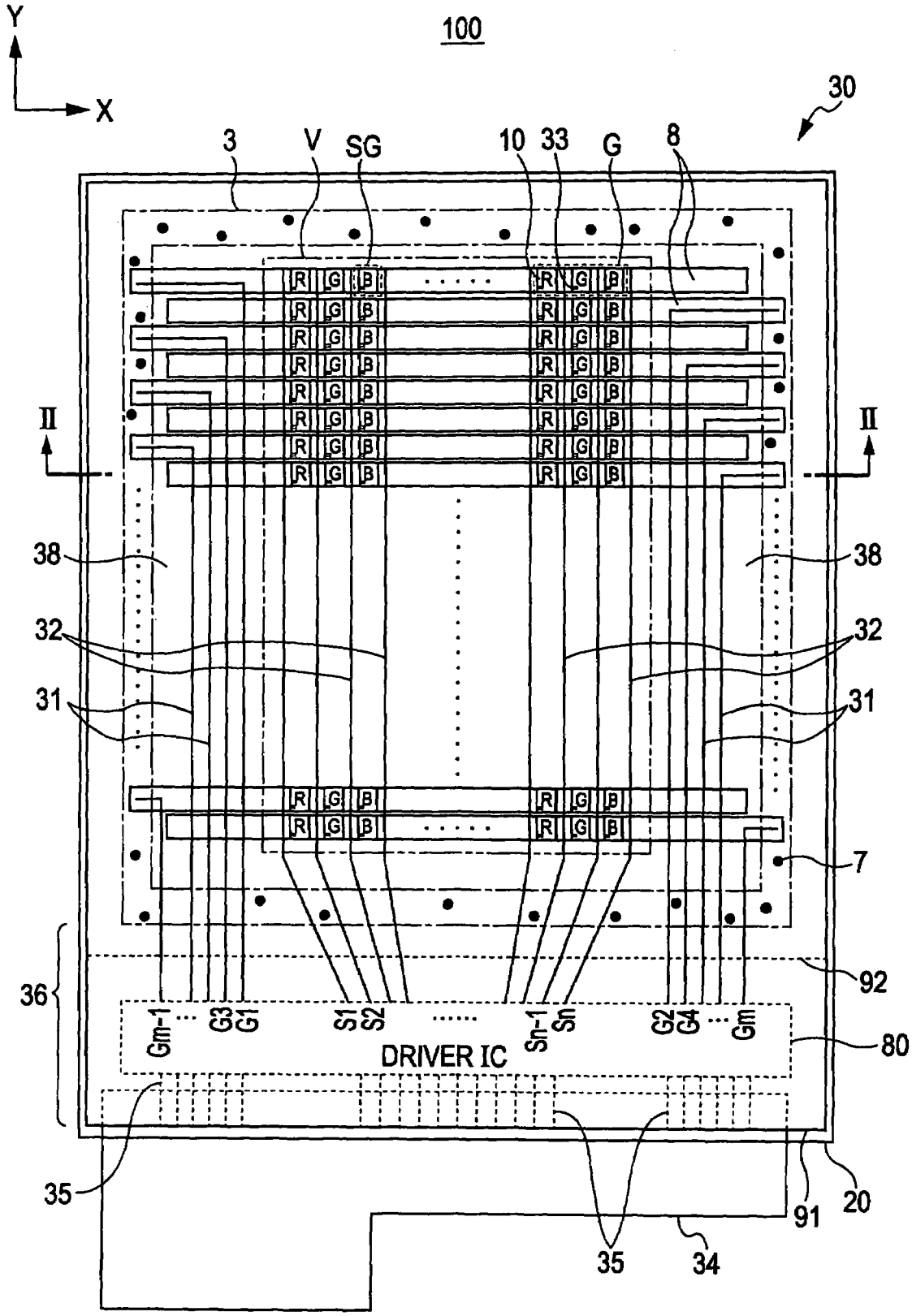
FIG. 1 is a schematic plan view of a liquid crystal device according to an embodiment of the invention.
Figure 2:
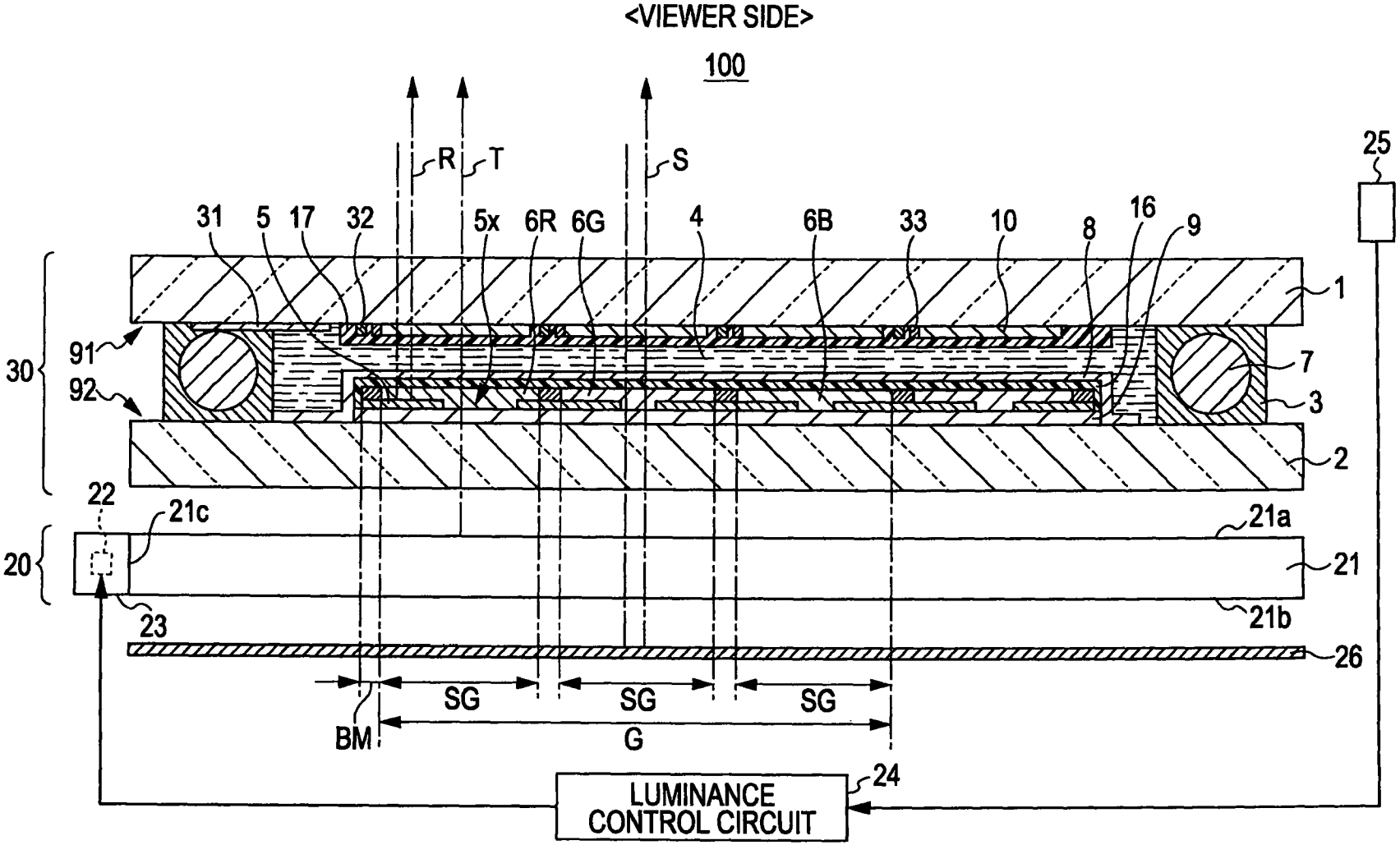
FIG. 2 is a cross sectional view of the liquid crystal device of FIG. 1, taken along line II-II.

Referring to FIGS. 1 and 2, the structure of a liquid crystal device 100 according to an embodiment of the invention will be described. A display region in one subpixel region SG is herein referred to as "a subpixel" and a display region in a pixel region G is sometimes referred to as "a pixel".

FIG. 1 is a schematic plan view of the liquid crystal device 100 according to the embodiment. The above in FIG. 1 is defined as Y-direction, and the right is defined as the X-direction for the convenience of description. The liquid crystal device 100 of this embodiment is a semitransmitting reflection liquid crystal device of an active matrix driving system using a thin-film diode (TFD) as an example of a two-terminal nonlinear element. FIG. 2 is a cross sectional view of the liquid crystal device 100 of FIG. 1, taken along line II-II, or particularly, taken along the subpixels arranged in the X-direction.

Referring first to FIG. 2, the cross sectional structure of the liquid crystal device 100 will be described.

The liquid crystal device 100 basically comprises a liquid-crystal display panel 30 and an illuminating unit 20.

The liquid-crystal display panel 30 includes a device substrate 91 disposed on the viewer side and a color filter substrate 92 opposing to the device substrate 91 and disposed opposite to the viewer, which are bonded with a frame-shaped sealing member 3 in between. Liquid crystal is sandwiched in the region partitioned by the frame-shaped sealing member 3 to form a liquid crystal layer 4. The frame-shaped sealing member 3 contains multiple conducting materials 7 such as metal particles. Spacers (not shown) for keeping the thickness of the liquid crystal layer 4 even are disposed at random between the device substrate 91 and the color filter substrate 92.

The cross sectional structure of the color filter substrate 92 will be described.

The color filter substrate 92 has an insulating lower substrate 2 and a scattering layer 9 on the inner surface of the lower substrate 2, the scattering layer 9 having fine unevenness on the surface. On the inner surface of the scattering layer 9, a reflecting layer 5 made of a reflective material such as aluminum, an aluminum alloy, or a silver alloy is provided for each subpixel region SG which is the minimum unit for display. Since the reflecting layers 5 are disposed on the inner surface of the uneven scattering layer 9, the reflecting layers 5 also have unevenness, so that the light reflected by the reflecting layers 5 is scattered as appropriate. The reflecting layers 5 each have an opening 5*x*. The opening 5*x* has a specified proportion of area to the area of the whole subpixel region SG The portion of the subpixel region SG corresponding to the opening 5*x* is set as a transmitting region for the light emitted from the illuminating unit 20 into the liquid-crystal display panel 30 to pass through. The portion of the reflecting layer 5 other than the opening 5*x* is set as a reflecting region where the extraneous light incident on the liquid-crystal display panel 30 from the viewer side is reflected.

A light-shielding layer BM is disposed on the inner surface of the reflecting layer 5 and between the subpixel regions SG. A red layer 6R, a green layer 6G, or a blue layer 6B is provided for the subpixel region SG on the inner surface of the reflecting layers 5 and the inner surface of the scattering layer 9 located in the opening 5*x*. The colored layers 6R, 6G, and 6B constitute a color filter. One pixel region G indicates a region corresponding to one color pixel made up of R, G, and B subpixels. In the following description, a colored layer is simply referred to as "a colored layer 6" when it is designated without distinction of color, while it is referred to as "a colored layer 6R" when it is designated with distinction of color. As shown in FIG. 2, the colored layer 6 at the opening 5*x* is thicker than that of the colored layer 6 on the reflecting layer 5. This allows desired hue and brightness to be provided both in a reflection display mode and in a transmission display mode.

A protecting layer 16 made of transparent resin is provided on the inner surface of the colored layers 6 and the light-shielding layers BM. The protecting layer 16 has the function of protecting the colored layers 6 from corrosion or contamination due to chemicals used during manufacture of the liquid-crystal display panel 30. The protecting layer 16 has, on the inner surface, stripe scanning lines (scanning electrodes) 8 made of a transparent conducting material such as indium-tin oxide (ITO). One end of the scanning line 8 is located in the sealing member 3 into electrical connection with the conducting materials 7 mixed in the sealing member 3. There is an alignment film (not shown) made of an organic material such as polyimide resin on the inner surface of the scanning lines 8.

The structure of the device substrate 91 will then be described.

An insulating upper substrate 1 has, on the inner surface, a TFD element 33 and a pixel electrode 10 that is electrically connected to the TFD element 33 every subpixel region SG There are straight data lines 32 made of a conducting material such as chrome between adjacent pixel electrodes 10 on the inner surface of the display panel. The data lines 32 are electrically connected to the corresponding TFD elements 33. Thus the data lines 32 are each electrically connected to the pixel electrode 10 via the TFD element 21.

There is a protecting layer 17 made of transparent resin at least on the inner surface of the TFD elements 33 and the pixel electrodes 10. A plurality of wires 31 is provided on the right and left rims of the inner surface of the upper substrate 1. One end of each wire 31 is in the sealing member 3 into electrical connection with the conducting materials 7 mixed in the sealing member 3. Accordingly, the wires 31 in the sealing member 3 and the scanning lines 8 on the lower substrate 2 are electrically vertically continuous via the conducting materials 7 mixed in the sealing member 3. There is an alignment film (not shown) made of an organic material such as polyimide on the inner surface of the protecting layer 17.

The illuminating unit 20 is disposed to the outer side of the color filter substrate 92.

The illuminating unit 20 includes an optical waveguide 21, a light source 23 mounted to one end face of the optical waveguide 21, and a reflecting sheet 26. The light source 23 contains a light emitting diode (LED) 22.

The LED 22 is electrically connected to a luminance control circuit 24 disposed in an electronic device, to be described later. The luminance control circuit 24 is electrically connected to a photosensor 25. The photosensor 25 is, for example, a photodiode, which measures the illuminance (in $cd \cdot m^{-2}$) of ambient light, and outputs a voltage corresponding to the illuminance of the ambient light to the luminance control circuit 24. The voltage output to the luminance control circuit 24 is in proportion to the logarithm of the illuminance of the ambient light measured by the photosensor 25. The luminance control circuit 24 changes the luminance of the LED 22 in response to an electrical signal corresponding to the voltage supplied.

The invention is applicable not only to the semitransmitting reflection liquid-crystal display panel 30 but also to a completely transmitting liquid-crystal display panel having no reflecting layer 5.

For reflection display of the liquid crystal device 100, extraneous light incident on the liquid crystal device 100 travels along a pass R shown in FIG. 1. That is, the extraneous light incident on the liquid crystal device 100 from the viewer side is reflected by the reflecting layer 5 to reach the viewer. In this case, the extraneous light passes through the region of the colored layer 6, and is reflected by the reflecting layer 5 under the colored layer 6 to pass through the colored layer 6 again, thereby providing specified hue and brightness. Thus, a desired color image can be viewed by the viewer.

On the other hand, for transmission display, the LED 22 in the light source 23 emits light, and the light enters the optical waveguide 21 through a light-incident-end face 21*c* of the optical waveguide 21. The light incident on the optical waveguide 21 is repeatedly reflected by a light-exiting surface 21*a* of the optical waveguide 21 adjacent to the color filter substrate 92 and a reflecting surface 21*b* opposite to the light-exiting surface 21*a* to thereby propagate in the optical waveguide 21 to the right. The light propagating in the optical waveguide 21 exits from the light-exiting surface 21*a* toward the liquid-crystal display panel 30 when the critical angle with respect to the light-exiting surface 21*a* is exceeded. When the light exceeds the critical angle with respect to the reflecting surface 21*b* to exit from the reflecting surface 21*b* toward the reflecting sheet 26, the light is reflected by the reflecting sheet 26 to be returned into the optical waveguide 21 again. The light radiated to the liquid-crystal display panel 30 thus travels along a pass T shown in FIG. 2 to pass through the transmitting region, that is, the colored layer 6 at the opening 5*x* and the liquid crystal layer 4, to reach the viewer. In this case, the radiated light passes through the colored layer 6 and the liquid crystal layer 4 to thereby provide specified hue and brightness. Thus a desired color image is viewed by the viewer.

Furthermore, in either of the reflection display mode and the transmission display mode, the extraneous light incident on the liquid-crystal display panel 30 travels along a path S shown in FIG. 2 and is reflected by the reflecting sheet 26 to pass through the colored layer 6 again, thereby providing specified hue and brightness. This also allows the viewer to view a desired color image.

Arrangement of Electrodes and Wires

Figure 3:
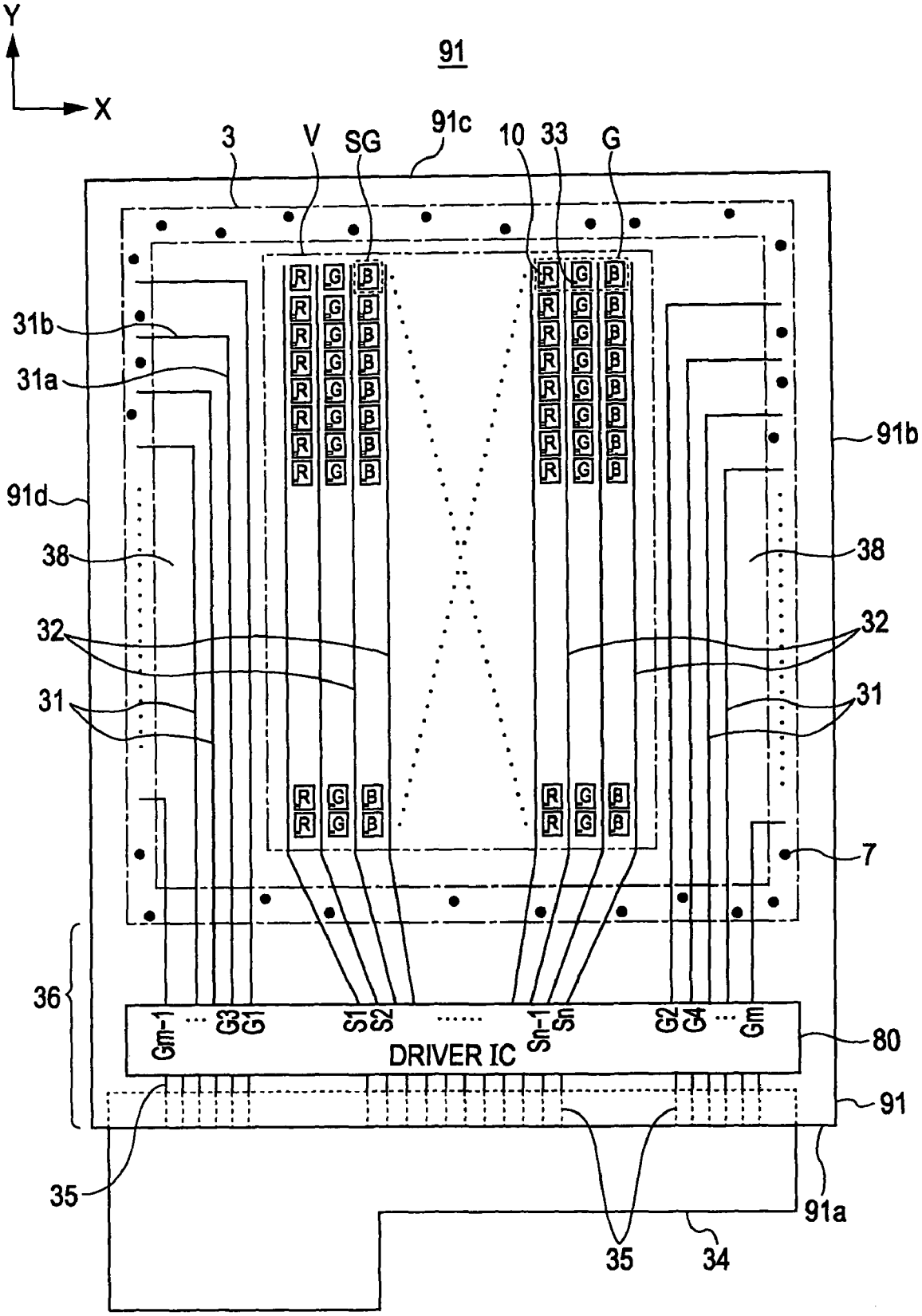
FIG. 3 is a schematic plan view of a device substrate according to the embodiment.
Figure 4:
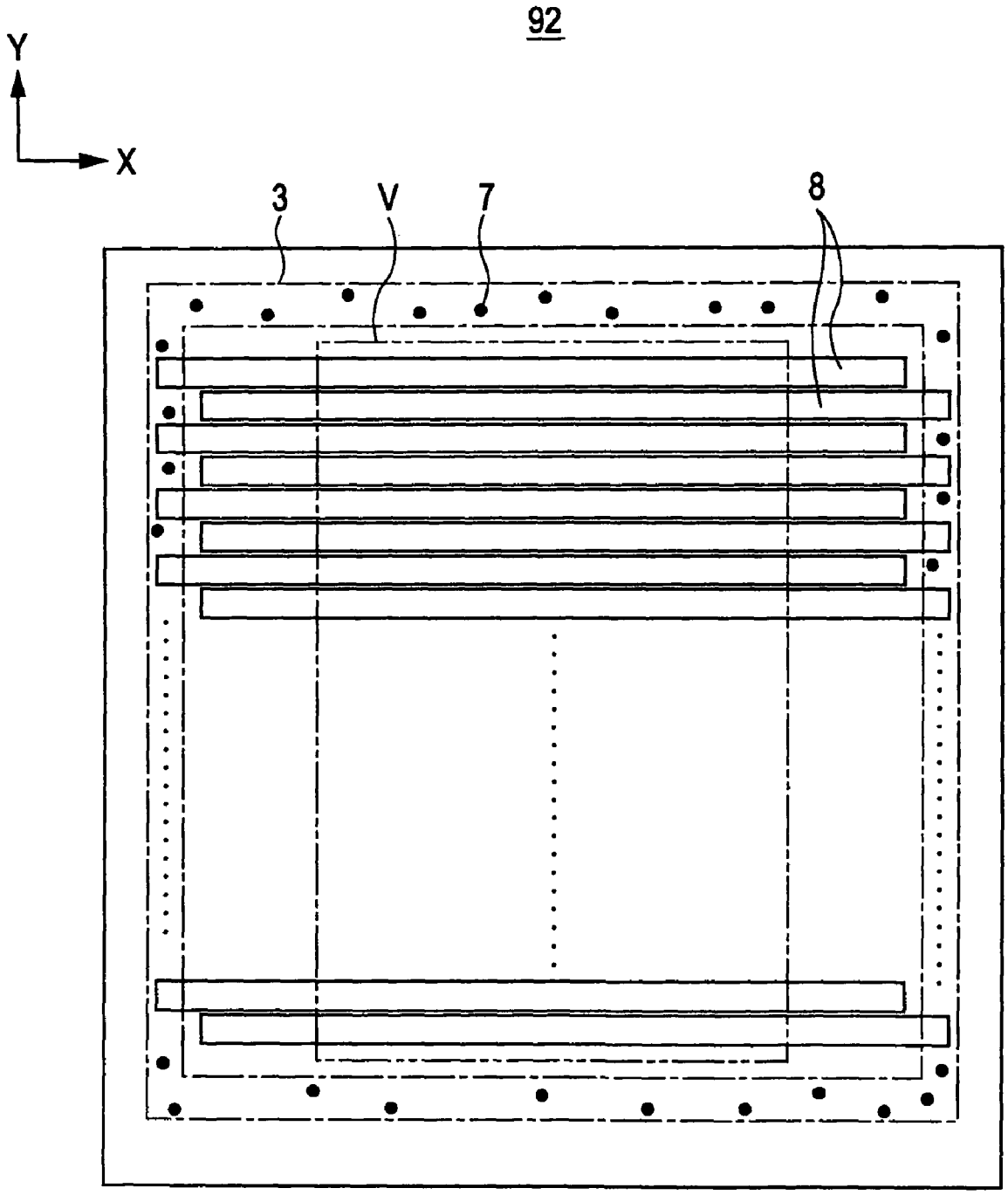
FIG. 4 is a schematic plan view of a color filter substrate according to the embodiment.

Referring then to FIGS. 1, 3, and 4, the arrangement of the electrodes and wires on the device substrate 91 and the color filter substrate 92 will be described. FIG. 3 is a plan view of the electrodes and wires on the device substrate 91 as viewed from the front (from below in FIG. 2); and FIG. 4 is a plan view of the electrodes on the color filter substrate 92 as viewed from the front (from above in FIG. 2). FIGS. 3 and 4 do not show the other components other than the electrodes and wires for the convenient of description.

Referring to FIG. 1, the pixel electrode 10 of the device substrate 91 and the scanning line 8 of the color filter substrate 92 intersect to form a subpixel region SG or the minimum unit of display. A plurality of the subpixel regions SG are arranged vertically and laterally in matrix form to form an effective display region V (surrounded by a two-dot chain line). In this effective display region V is displayed an image such as a character, a numeral, or a figure. Referring to FIGS. 1 and 3, the region defined by the outer periphery of the liquid crystal device 100 and the effective display region V is a frame region 38 not for use in image display.

The arrangement of the electrodes and wires of the device substrate 91 will now be described.

Referring to FIG. 3, the device substrate 91 includes the TFD electrodes 33, the pixel electrodes 10, the wires 31, the data lines 32, a driver IC 80, and a plurality of externally connecting terminals 35.

The device substrate 91 includes an extension 36 extending externally from one end of the color filter substrate 92. On the extension 36 is provided the driver IC 80 with an anisotropic conductive film (ACF) or the like in between. In FIG. 3, the direction from a side 91*a* of the device substrate 91 adjacent to the extension 36 to the opposite side 91*c* is specified as a Y-direction, while the direction from a side 91*d* to the opposite side 91*b* is specified as an X-direction.

The extension 36 has the externally connecting terminals 35. The input terminals (not shown) of the driver IC 80 are connected to the externally connecting terminals 35 with conductive bumps, respectively. The externally connecting terminals 35 are connected to a flexible printed circuit board (FPC) with and an ACF or solder. The FPC 34 is electrically connected to an electronic device, to be described later.

The output terminals (not shown) of the driver IC 80 are electrically connected to the data lines 32 and the wires 31 with conductive bumps, respectively. Thus the driver IC 80 can supply data signals to the data lines 32, and scanning signals to the scanning lines 8, respectively.

The data lines 32 are straight wires extending vertically in the drawings, which extend from the extension 36 in the Y-direction across the effective display region V. The data lines 32 are provided at regular intervals in the X-direction, and are each electrically connected to a corresponding TFD element 33. Each TFD element 33 is electrically connected to a corresponding pixel electrode 10.

The wires 31 each include a main line 31*a* and a bent portion 31*b* bent from an end of the main line 31*a* to the sealing member 3. The main line 31*a* extends from the extension 36 in the Y-direction in the frame region 38. An end (terminal) of the bent portion 31*b* is located in the sealing member 3 on the left or right of the drawing, and is electrically connected to the conducting materials 7 mixed in the sealing member 3.

The structure of the electrode of the color filter substrate 92 is as follows:

Referring to FIG. 4, the color filter substrate 92 includes the stripe scanning lines 8 extending in the X-direction. The right or left end of each scanning line 8 is located in the sealing member 3, as shown in FIGS. 1 and 4, into electrical connection with the conducting material 7 in the sealing member 3.

FIG. 1 shows a state in which the color filter substrate 92 and the device substrate 91 are bonded with the sealing member 3 in between. The scanning lines 8 of the color filter substrate 92 intersect the data lines 32 of the device substrate 91 substantially at right angles, and overlap with the pixel electrodes 10 arranged in the X-direction. The region where the scanning lines 8 and the pixel electrode 10 overlap configures the subpixel regions SG The scanning lines 8 of the color filter substrate 92 and the wires 31 of the device substrate 91 overlap alternately on the right side and the left side, and are vertically conducting via the conducting materials 7 in the sealing member 3, as shown in FIG. 1. That is, the conduction between the scanning lines 8 and the wires 31 are alternately established on the right side and the left side. Thus, the scanning lines 8 of the color filter substrate 92 are electrically connected to the driver IC 80 via the wires 31 of the device substrate 91.

Method for Automatically Controlling the Light of Illuminating Unit

Figure 5:
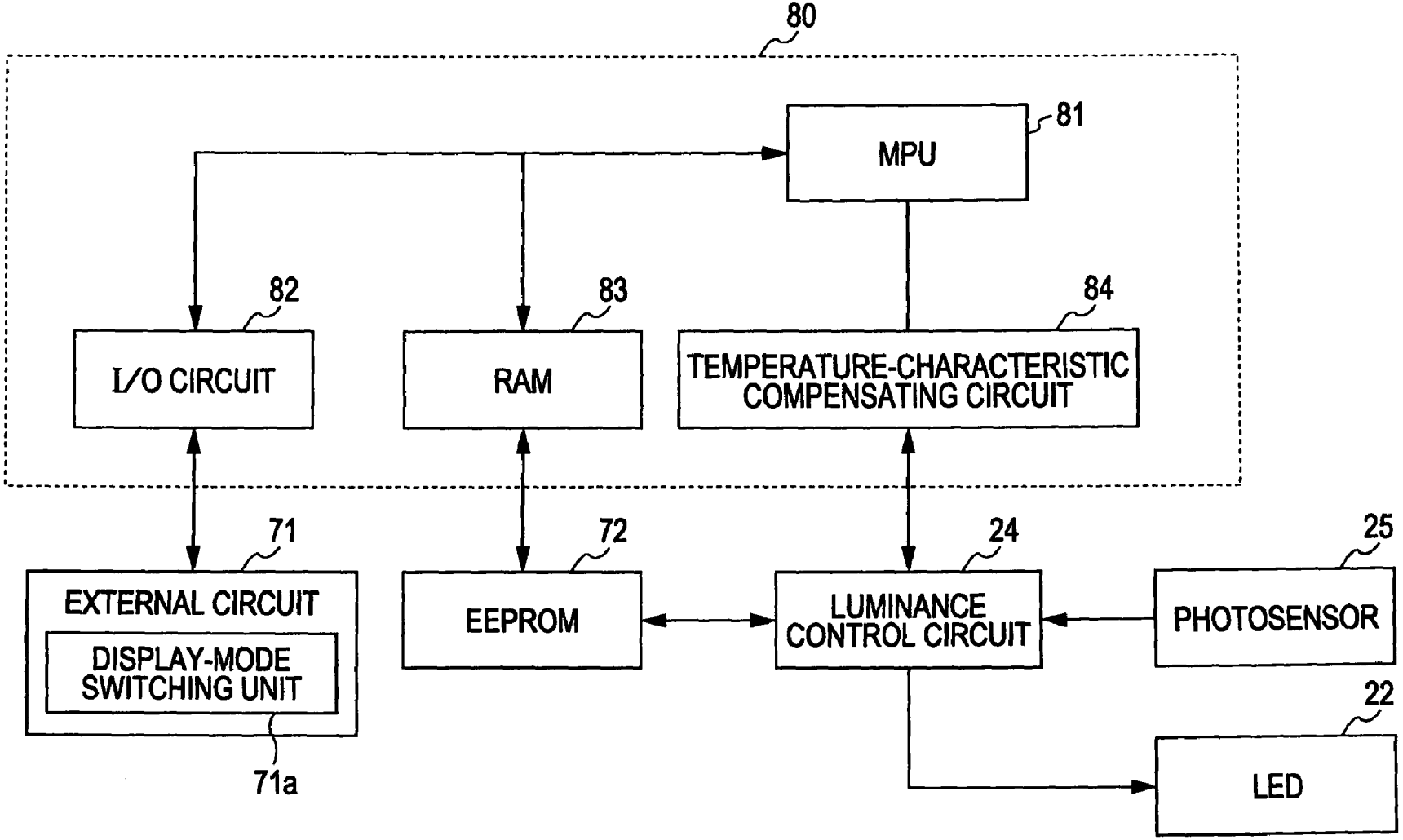
FIG. 5 is a block diagram showing the electrical configuration of automatic light control of an illuminating unit.
Figure 6:
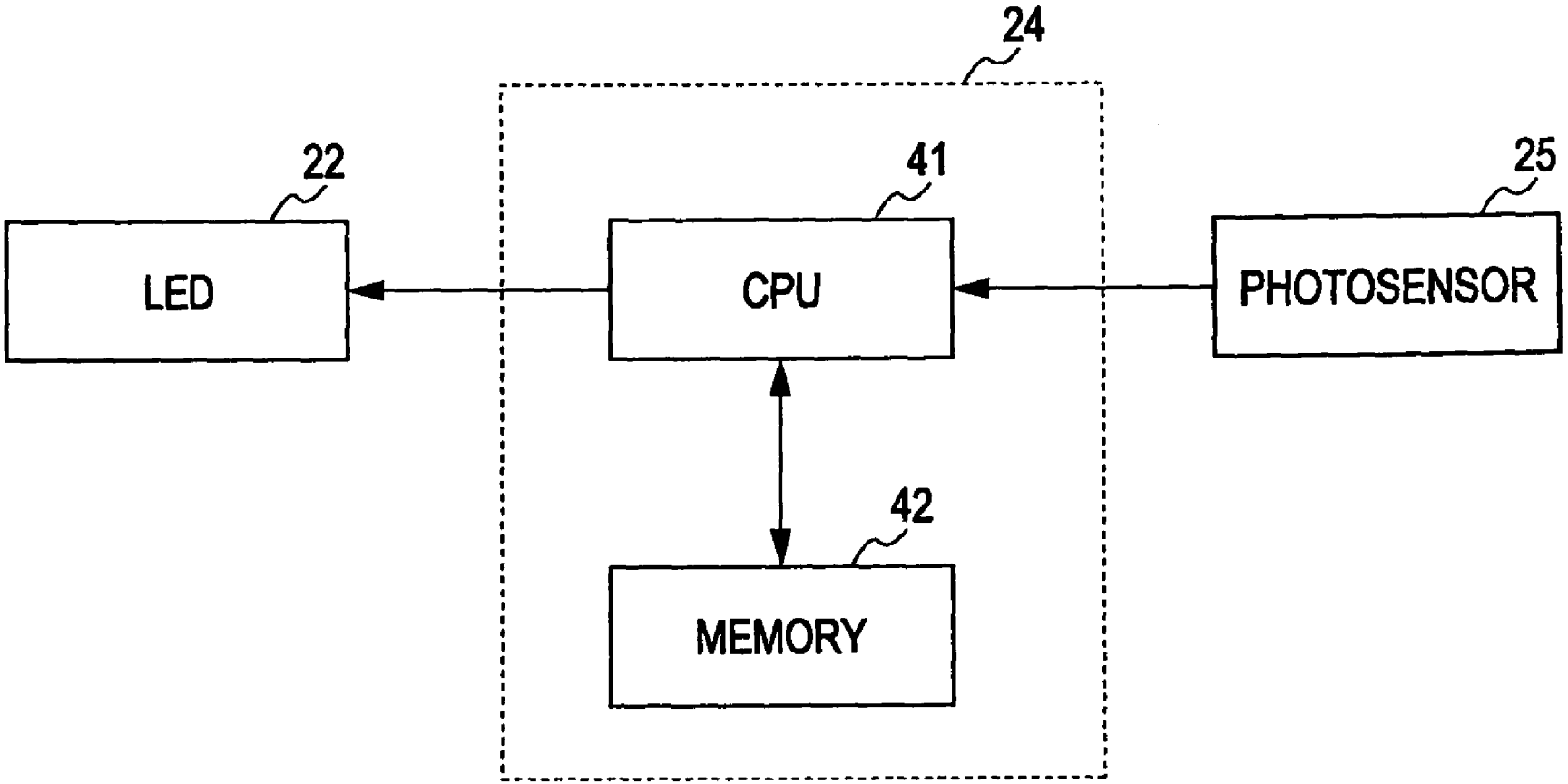
FIG. 6 is a block diagram of a luminance control circuit.

Referring to FIGS. 5 and 6, a method for controlling the light of the illuminating unit 20 according to an embodiment of the invention will be described.

FIG. 5 is a block diagram of the electrical configuration of the method for controlling the light of the illuminating unit 20.

According to an embodiment of the invention, the light of the illuminating unit 20 is automatically controlled in cooperation with the driver IC 80, the photosensor 25, the LED 22 of the illuminating unit 20, an external circuit 71, an electronically erasable and programmable read-only memory (EEPROM) 72, and the luminance control circuit 24. The driver IC 80 includes a microprocessor (MPU) 81, an input/output circuit 82, a random access memory (RAM) 83, and a temperature-characteristic compensating circuit 84. Preferably, the external circuit 71, the EEPROM 72, and the luminance control circuit 24 are disposed in an electronic device, to be described later.

The input/output circuit 82 is electrically connected to the external circuit 71 via the externally connecting terminals 35 and the FPC 34. The external circuit 71 includes an input/output circuit, a processor, various memories, and various registers (not shown). The external circuit 71 further includes a display-mode switching unit 71*a* that switches the display mode to a transmission display mode when the illuminance of the ambient light measured by the photosensor 25 is at a specified level (more preferably, when the illuminance is 1,000 lx or lower (dark)), and switches the display mode to a reflection display mode when the illuminance of the ambient light is higher than 1,000 lx (light), and outputs the switching signal to the MPU 81 via the input/output circuit 82 or the like.

The EEPROM 72 serving as a storage means stores a plurality of tables listing data corresponding to a gamma value applied at least in transmission display mode (hereinafter, referred to as "transmission-display gamma data γ1") and data corresponding to a gamma value applied to a reflection display mode (hereinafter referred to as reflection-display gamma data γ2) in a general expression $L=KE^{\gamma}$ where L is the optimum surface luminance, K is the constant, γ is the gamma value of the optimum surface luminance, to be described later, and E is a driving voltage for the liquid-crystal display panel 30. It is desirable that the transmission-display gamma data γ1 be set to 1.8, while the reflection-display gamma data γ2 be set to 2.2. This is because reflecting color filters are often lighter in color (more whitish) than transmitting color filters.

The MPU 81 controls the automatic light control process of the illuminating unit 20 according to the embodiment. The MPU 81 applies the gamma value of the liquid-crystal display panel 30 to the transmission-display gamma data γ1 or the reflection-display gamma data γ2 under specified conditions. Specifically, the MPU 81 loads the transmission-display gamma data γ1 from the tables stored in the EEPROM 72 to the RAM 83 according to the outputs (data on the illuminance of the ambient light) obtained from the luminance control circuit 24 in response to the transmission display mode switching signal output from the external circuit 71 to thereby obtain it, and replaces the gamma value of the liquid-crystal display panel 30 with the transmission-display gamma data γ1; and on the other hand, loads the reflection-display gamma data γ2 from the tables stored in the EEPROM 72 to the RAM 83 according to the outputs (data on the illuminance of the ambient light) obtained from the luminance control circuit 24 in response to the reflection display mode switching signal output from the external circuit 71 to thereby obtain it, and replaces the gamma value of the liquid-crystal display panel 30 with the reflection-display gamma data γ2. The MPU 81 makes a gamma correction by a gamma correction circuit (not shown) by a known method according to the transmission-display gamma data γ1 or the reflection-display gamma data γ2 to control the display luminance of the liquid-crystal display panel 30.

The temperature-characteristic compensating circuit 84 is a circuit for compensating the variations of the outputs of the photosensor 25 and the LED 22 due to temperature drift. Accordingly, even if the photosensor 25 and the LED 22 have temperature drift by the change of ambient temperature environment, the outputs of the photosensor 25 and the LED 22 can be compensated to appropriate values by the temperature-characteristic compensating circuit 84. The luminance control circuit 24 controls the amount of the current to the LED 22 on the basis of the value of the voltage sent from the photosensor 25 to change the luminance of the LED 22 under the control of the MPU 81. When the current to the LED 22 is increased, the light emitted from the LED 22 becomes light; when the current to the LED 22 is decreased, the light from the LED 22 becomes dark.

FIG. 6 is a block diagram showing the electrical configuration of the luminance control circuit 24. The luminance control circuit 24 includes a central processing unit (CPU) 41 and a memory 42, such as a RAM, connected to the CPU 41. The CPU 41 is electrically connected to the photosensor 25 and the LED 22.

In the luminance control circuit 24, the CPU 41 determines the amount of current to be supplied to the LED 22 on the basis of the voltage output from the photosensor 25 according to the light control profile stored in the memory 42. The invention may be constructed such that a light control profile is stored in the EEPROM 72 and loaded from the EEPROM 72 to the memory 42 as necessary. The CPU 41 regulates the amount of current to be flowed to the LED 22 to the determined value. The luminance control circuit 24 outputs data corresponding to the illuminance of the ambient light measured by the photosensor 25 to the MPU 81. A method for generating the light control profile will be specifically described.

Figure 7:
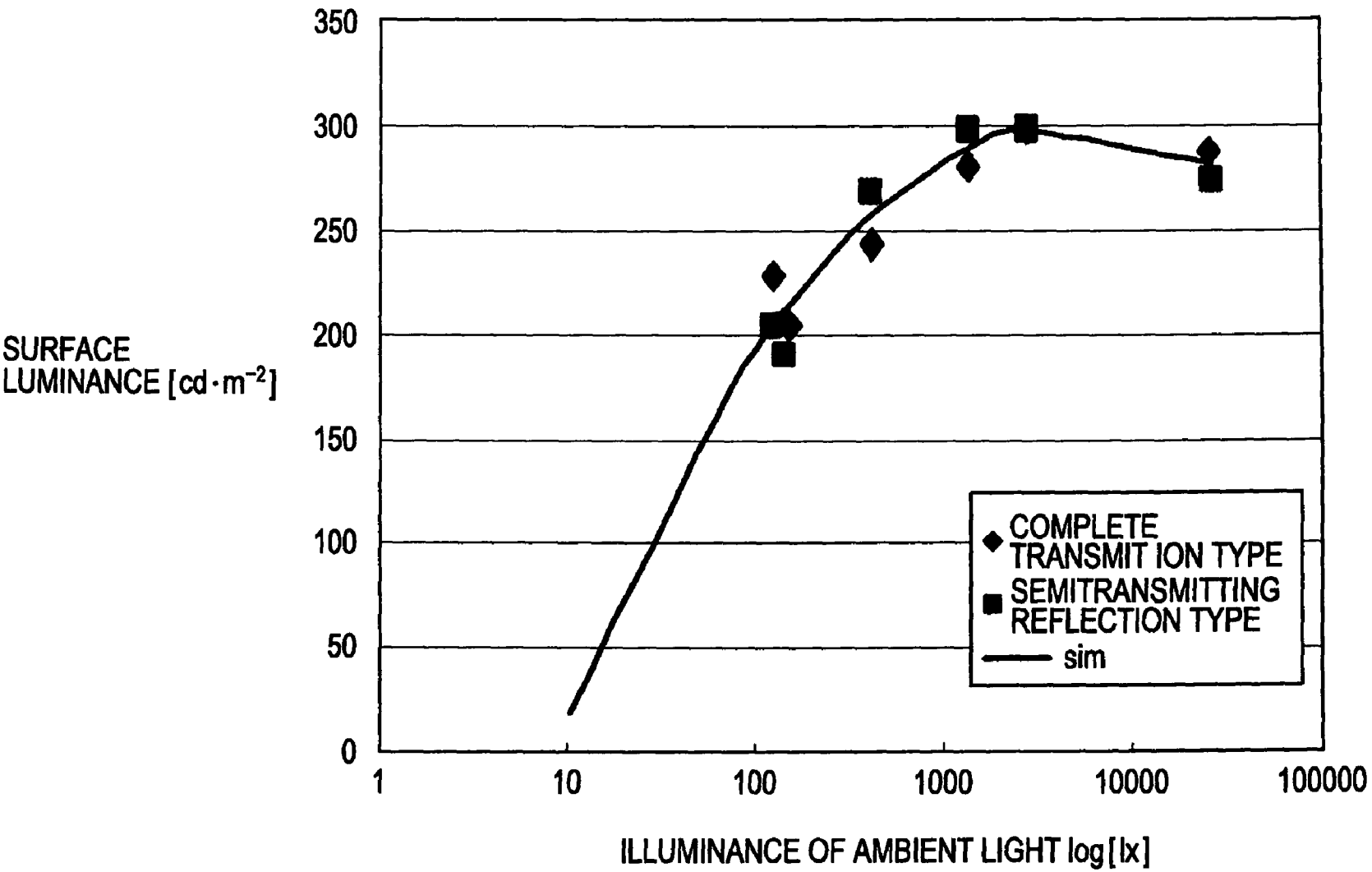
FIG. 7 is the plot of the relationship between the luminance of ambient light and the optimum surface luminance.

FIG. 7 is a graph of the luminance of the display screen on the surface of the liquid-crystal display panel (hereinafter, also referred to as a surface luminance) when humans feel the display screen easy to view plotted against the illuminance of the ambient light. FIG. 7 plots the illuminance of the ambient light in abscissa and the luminance of the display screen in ordinate. The graph of FIG. 7 shows experimental results for a complete-transmission-type liquid crystal device and a semitransmitting-reflection-type liquid crystal device. Specifically, the two types of display screen are shown to several subjects, and the luminances of the display screens that the subjects feel easy to see, that is, the optimum surface luminances are measured for the several illuminances of ambient light. The optimum surface luminance here indicates the luminance of light emitted from the illumination system and passing through the liquid-crystal display panel. In FIG. 7, the diamond-shaped point indicates a point of measurement for the complete-transmission-type liquid crystal device, while the square point indicates a point of measurement for the semitransmitting-reflection-type liquid crystal device.

Referring to FIG. 7, when the illuminance of the ambient light increases to around 8,000 lx, the optimum surface luminance also increases; when the illuminance of the ambient light decreases, the optimum surface luminance also decreases. This is because when it is dark in the surroundings, a dark display screen is easier for the subjects to see; when it is light in the surroundings, a light display screen is easier to see. When the illuminance of the ambient light is higher than 8,000 lx, the optimum surface luminance decreases as the illuminance of the ambient light increases. This is because when the illuminance of the ambient light becomes higher than 8,000 lx, the luminance of the reflected light of the ambient light from the display screen reaches a sufficient luminance for illuminating the display screen. In other words, since the luminance of the reflected light becomes higher than that of the transmitted light from the illuminating unit, the need for lighting the display screen with the transmitted light from the illuminating unit is eliminated. Accordingly, when the illuminance of the ambient light is around 8,000 lx, the optimum surface luminance becomes the maximum value of 300 $cd \cdot m^{-2}$. At that time, the luminance of the reflected light of the ambient light and that of the light emitted from the illuminating unit and passing through the liquid-crystal display panel are equal on the display screen of the liquid-crystal display panel. Both the luminances of the transmitted light and the reflected light become the maximum of the optimum surface luminance.

The curve sim is the approximate curve of the points of measurement of the complete-transmission-type liquid crystal device and the semitransmitting-reflection-type liquid crystal device. The shape of the curve sim shows that the luminance on the surface of the liquid crystal panel when humans feel the display screen easy to see varies in the form of a concave approximate quadratic curve against the logarithms of the illuminances of the ambient light.

The experimental results show that the variations in the optimum surface luminance with respect to the illuminance of the ambient light are substantially the same in both of the complete-transmission-type liquid crystal device and the semitransmitting-reflection-type liquid crystal device. This is because the semitransmitting-reflection-type liquid crystal device used in this experiment less reflects light by the reflecting layer. Specifically, with the semitransmitting-reflection-type liquid crystal device, the reflected light by the reflecting layer little influences the luminance of the whole reflected light of the liquid-crystal display panel; the luminance of the reflected light of the entire liquid-crystal display panel depends on the luminance of the reflected light of the ambient light by the reflecting sheet of the illuminating unit. The reflecting sheet is provided both for the semitransmitting-reflection-type liquid crystal device and the complete-transmission-type liquid crystal device. Accordingly, the changes in the optimum surface luminance by this experiment show substantially the same characteristic both in the complete-transmission-type liquid crystal device and the semitransmitting-reflection-type liquid crystal device.

Figure 8:
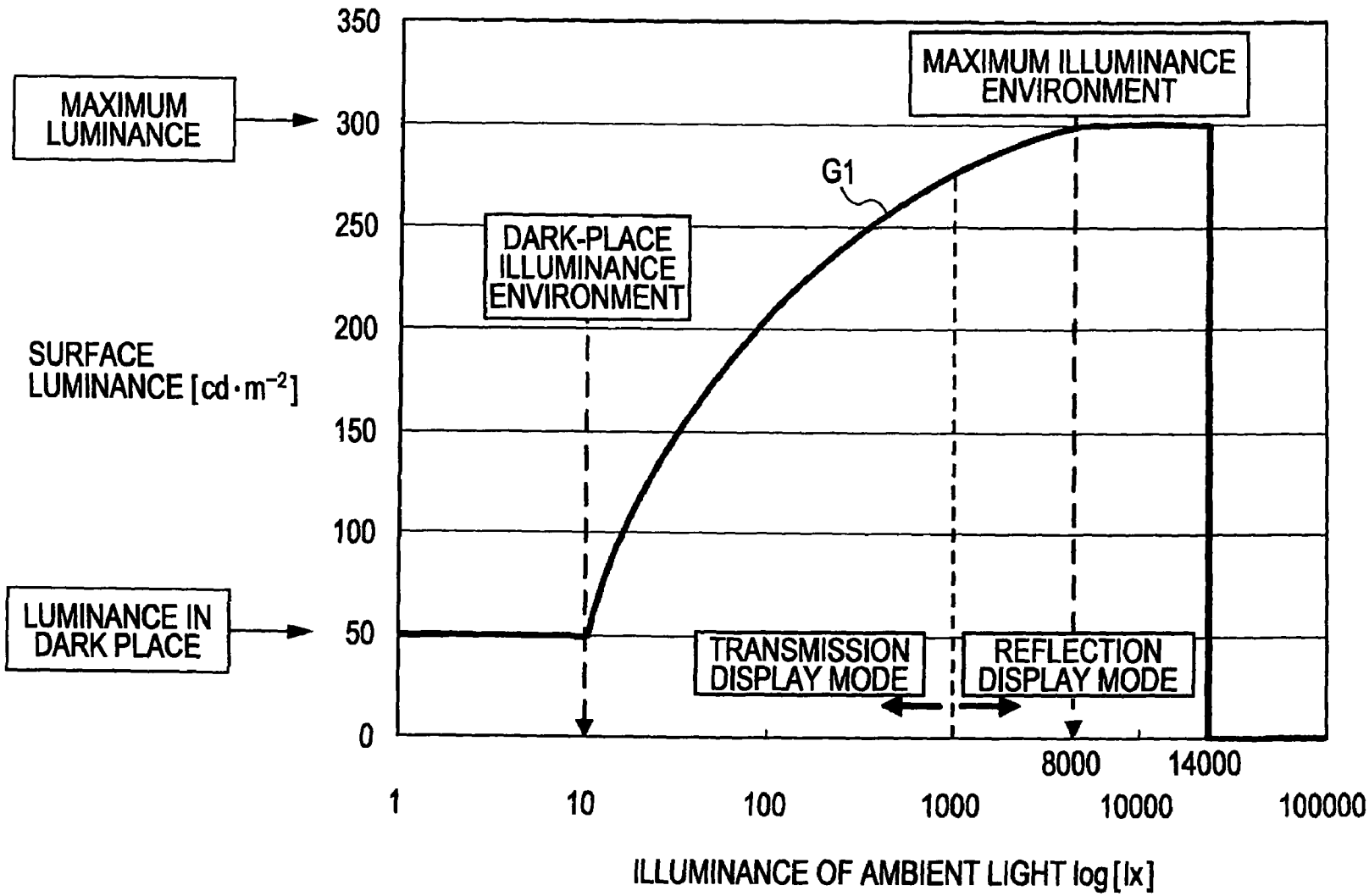
FIG. 8 shows an example of a light control profile.

FIG. 8 shows an example of the light control profile produced on the basis of the experimental results of FIG. 7. FIG. 8 plots the illuminance of the ambient light in abscissa and the optimum surface luminance in ordinate. A method for producing the light control profile will be described hereinbelow.

The illuminance of the ambient light with the optimum surface luminance at the maximum (hereinafter, simply referred to as "the maximum illuminance environment") is first obtained. When the illuminance of the ambient light becomes the maximum illuminance environment, the luminance control circuit 24 maximizes the optimum surface luminance. The maximum value of the optimum surface luminance is preferably the maximum luminance of the display screen, which is determined by the maximum luminance of the illuminating unit when the amount of the current supplied to the LED 22 is maximized and the transmittance of the panel. However, there is no need to set the maximum value of the optimum surface luminance to the maximum luminance, and it may be set to 90 percent of the maximum luminance. Actually, the reflectance that is the proportion of the light reflected by the liquid-crystal display panel to the light incident on the liquid-crystal display panel is measured in advance. Then the environment parameter is obtained by Eq. (1) from the reflectance and the maximum value of the optimum surface luminance.

$$\text{Environment parameter}=(\text{the maximum value of the optimum surface luminance})/\text{reflectance} \quad (1)$$

The environment parameter indicates the illuminance of the ambient light when the luminances of both of the reflected light and transmitted light of the liquid-crystal display panel are equal, in which case the luminances of reflected light and the transmitted light become the maximum value of the optimum surface luminance. With the complete-transmission-type liquid crystal device, the value of the environment parameter can be 8,000 lx or higher because of low reflectance. When the value of the environment parameter is 8,000 lx or higher, the maximum illuminance environment is 8,000 lx. With the semitransmitting-reflection-type liquid crystal device, the value of the environment parameter is often smaller than 8,000 lx because of high reflectance. When the value of the environment parameter is smaller than 8,000 lx, the maximum illuminance environment is set as an environment parameter. The reason that the maximum illumination environment is set to 8,000 lx when the value of the environment parameter is 8,000 lx or higher, the display screen is viewed most often in places where the illuminance of the ambient light is 8,000 lx, and is seldom viewed in places where the illuminance of the ambient light is higher than that. This allows the optimum surface luminances of both of the complete-transmission-type liquid crystal device and the semitransmitting-reflection-type liquid crystal device to be agreed with the maximum value at the possible highest luminance as the illuminance of the ambient light in viewing the display screen.

A light control profile in the case where the illuminance of the ambient light is 10 lx or lower will be described. The place where the illuminance of the ambient light is 10 lx or lower is, for example, a dark room in which only an emergency light is lit. It is enough for such a dark room in which the illuminance of the ambient light is 10 lx or lower to provide the display screen with a luminance of 50 $cd \cdot m^{-2}$. Accordingly, as shown in FIG. 8, when the illuminance of the ambient light is 10 lx or lower, optimum surface luminance is set to a fixed luminance, 50 $cd \cdot m^{-2}$. The optimum surface luminance at that time is not limited to 50 $cd \cdot m^{-2}$, and may be changed to user preference, which is preferably set between 50 and 150 $cd \cdot m^{-2}$. The environment in which the illuminance of the ambient light is 10 lx is referred to as a dark-place illuminance environment and the optimum surface luminance at that time is referred to as a dark-place luminance. The setting of the dark-place illuminance environment to 50 $cd \cdot m^{-2}$, or preferably, to a specified value between 50 and 150 $cd \cdot m^{-2}$ enables the display screen to be illuminated at an appropriate luminance for users' eyes and allows power saving of the illuminating unit 20.

When the illuminance of the ambient light is higher than 10 lx, that is, when it is higher than the dark-place illuminance environment, the optimum surface luminance is indicated by a concave quadratic curve with respect to the logarithms of the illuminances of the ambient light and expressed as Eqs. (2) and (3).

$$Y = -At(\log(X) - \log(Kt))^2 + Bt \quad (2)$$

$$At = \frac{Bt - B0}{(\log(K0) - \log(Kt))^2} \quad (3)$$

where Y is the optimum surface luminance, X is the illuminance of the ambient light, Kt is the maximum illuminance environment, Bt is the maximum value of the optimum surface luminance, K0 is dark-place illuminance environment, and B0 is dark-place luminance.

Eqs. (2) and (3) are derived from the approximate curve sim of the experimental results of FIG. 7, which is the quadratic curve G1 of FIG. 8. For Eqs. (2) and (3), the optimum surface luminance is the maximum value in the maximum illuminance environment. Thus, the optimum surface luminance found by Eqs. (2) and (3) always provides the user with a display screen that is easy to see.

When the illuminance of the ambient light is higher than the maximum illuminance environment, the luminance of the reflected light of the ambient light becomes higher than that of the light emitted from the illuminating unit and passing through the liquid crystal panel. Accordingly, if the illuminance of the ambient light is higher than the maximum illuminance environment, for example, about 14,000 cd·m$^{-2}$ or higher, a necessary and sufficient surface luminance can be obtained from the ambient light. The luminance control circuit 24 therefore stops the emission of light by the illuminating unit 20 to the liquid-crystal display panel 30. Thus, the luminance of the display screen becomes 0 cd·m$^{-2}$, so that the power saving of the illuminating unit 20 can be achieved.

Luminance Control Process

Figure 9:
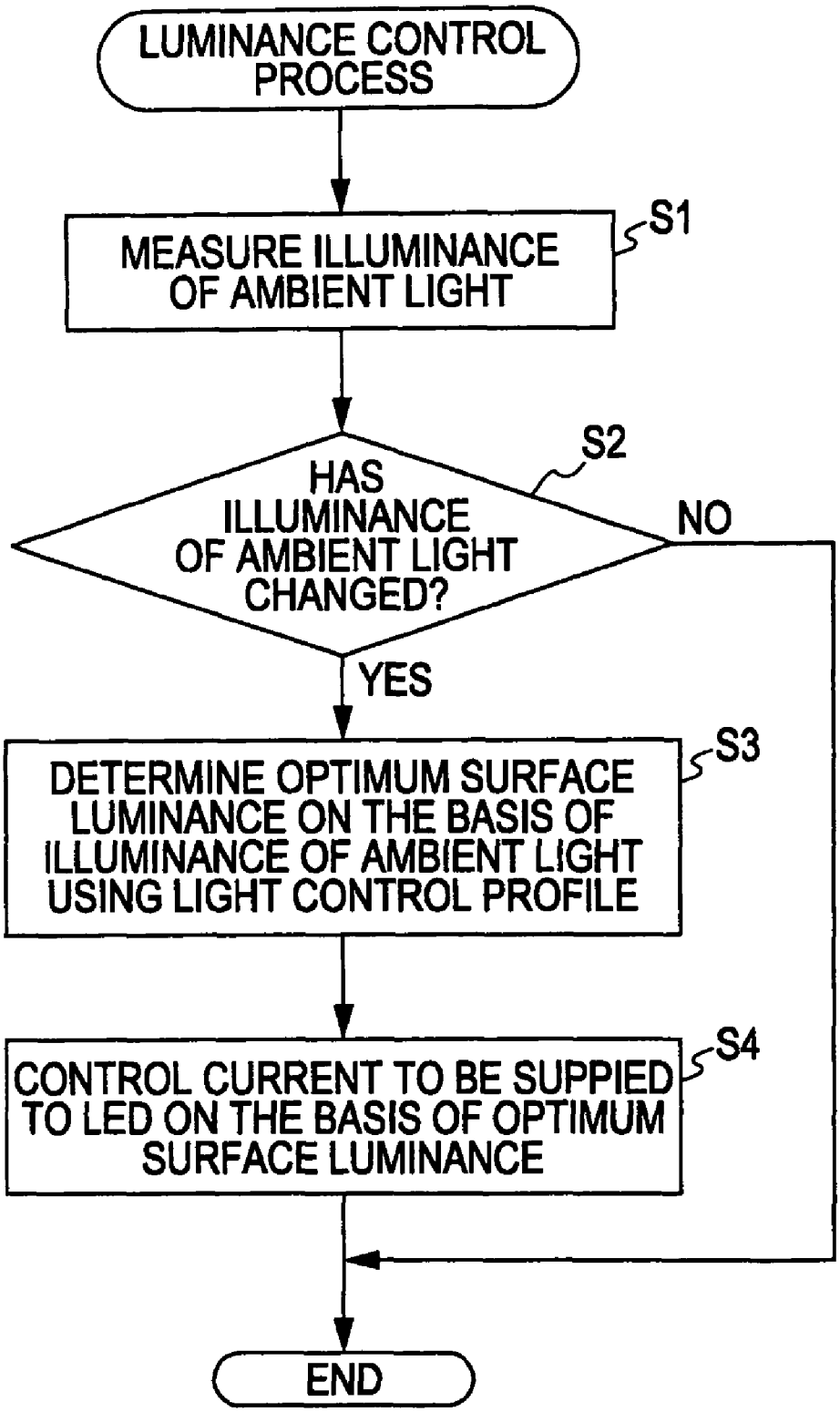
FIG. 9 is a flowchart of a luminance control process.

The luminance control process of the luminance control circuit 24 will be described with reference to the liquid crystal device 100 according to the embodiment. FIG. 9 is a flowchart of the luminance control process according to the embodiment. The relationship between the surface luminance of the liquid-crystal display panel 30 and the amount of current to be supplied to the LED 22 is first obtained by measurement, which is stored as a table in the memory 42 or the like. The light control profile described in FIG. 8 is also stored as an expression or a table in the memory 42 or the like. The relationship between the luminance of the ambient light measured by the photosensor 25 and the voltage output by the photosensor 25 is also stored as a table in the memory 42 or the like.

The photosensor 25 measures the illuminance of the ambient light and outputs a voltage corresponding to the luminance to the CPU 41 (step S1). The CPU 41 obtains the illuminance of the ambient light measured by the photosensor 25 from the table in the memory 42 according to the voltage value output from the photosensor 25, and determines whether the illuminance of the ambient light has changed (step S2). When the CPU 41 determines that the illuminance of the ambient light has not changed (step S2: No), the luminance control process is terminated. When the CPU 41 determines that the illuminance of the ambient light has changed (step S2: Yes), an appropriate luminance of the display screen, that is, the optimum surface luminance is obtained according to the illuminance of the ambient light from the light control profile in the memory 42 (step S3). The CPU 41 then obtains the amount of current to be supplied to the LED 22 so as to provide the LED 22 with the optimum surface luminance. The CPU 41 supplies the amount of current to the LED 22 to make the LED 22 emit light at a luminance at which the display surface has the optimum surface luminance (step S4), and terminates the luminance control process. Thus, the luminance of the display screen of the liquid-crystal display panel 30 can be automatically optimized according to the illuminance of the ambient light.

In the embodiment with such a structure, the light of the illuminating unit 20 can be automatically controlled by the luminance control circuit 24 to provide the optimum surface luminance for humans' visual sense according to the ambient light. The display-mode switching unit 71*a* can switch the display mode between the reflection display mode and the transmission display mode according to the illuminance of the ambient light, and the MPU 81 applies the transmitting-display gamma data γ1 or the reflecting-display gamma data γ2 corresponding thereto, so that the display luminance of the display panel can be controlled suitably. Consequently, the display quality can be improved while the power consumption of the illuminating unit 20 is reduced. Method for Automatically Controlling the Light of Illuminating Unit for the Purpose of Controlling Contrast In addition to the automatic light control for the illuminating unit 20, the embodiment may adopt a method for controlling the light of the illuminating unit 20 for the purpose of controlling contrast.

Figure 10:
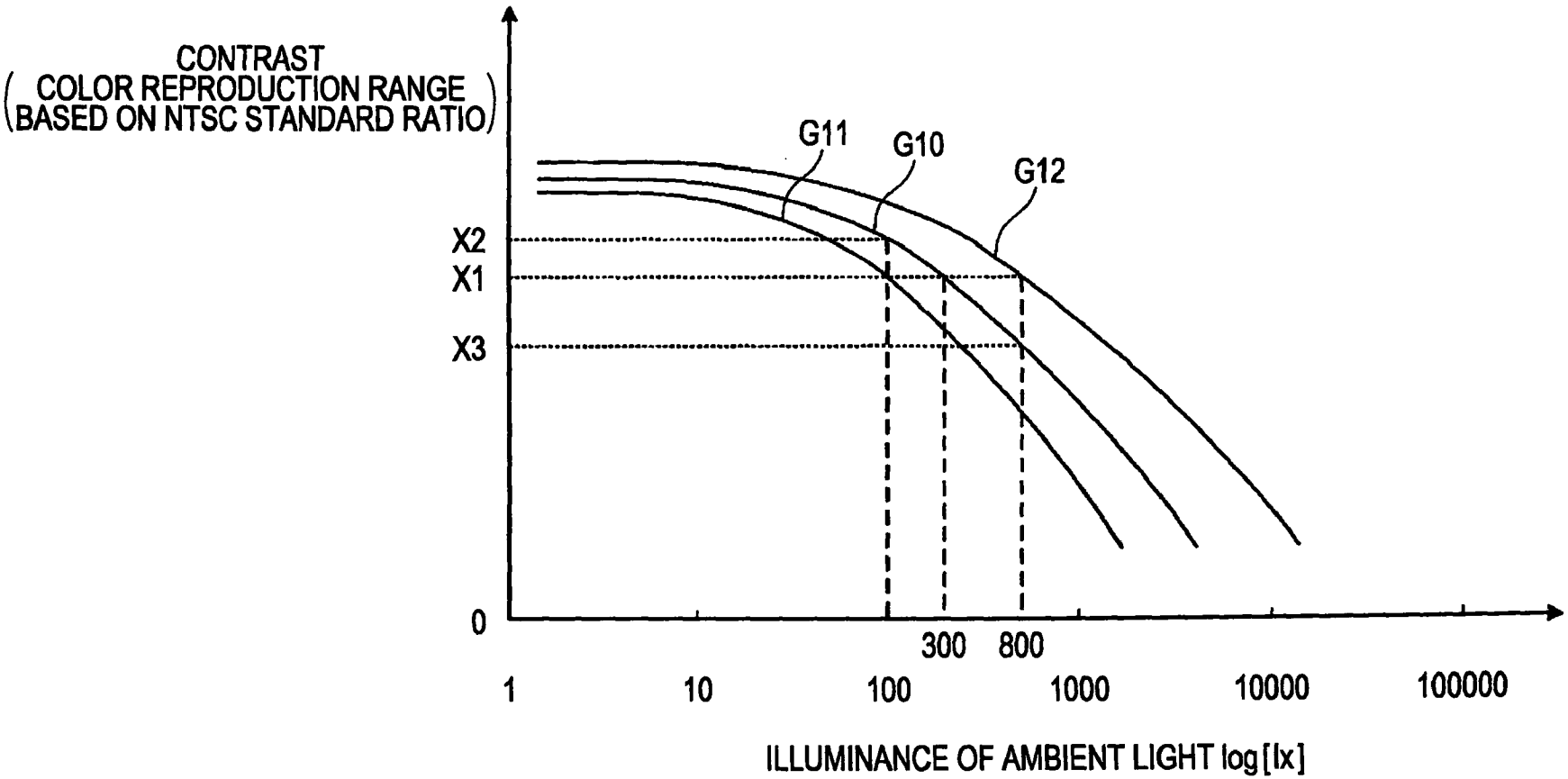
FIG. 10 is the plot of the automatic light control of an illuminating unit based on contrast/NTSC standard ratio.

Referring to FIGS. 5 and 10, a method for controlling the light of the illuminating unit 20 for the purpose of controlling the contrast according to the embodiment will be described. FIG. 10 plots the logarithm of the illuminance of the ambient light in abscissa and the contrast of the display screen of the liquid-crystal display panel 30 in ordinate. Graph G10 shows the relationship between the logarithm of the illuminance of the ambient light and the contrast when the luminance of the illuminating unit 20, that is, the amount of current to be supplied to the LED 22 is set to a value A1; graph G11 shows the relationship between the logarithm of the illuminance of the ambient light and the contrast when the luminance of the illuminating unit 20 is set to a value A2 (<A1); and graph G12 shows the relationship between the logarithm of the illuminance of the ambient light and the contrast when the luminance of the illuminating unit 20 is set to a value A3 (>A1). The graphs are stored in the EEPROM 72 of FIG. 5 as a plurality of tables.

It is preferable for the liquid crystal device 100 that the contrast be maintained constant even if the illuminance of the ambient light varies so as to maintain the display quality constant. However, the contrast is actually decreased as the illuminance of the ambient light increases; in contrast, when the illuminance of the ambient light decreases, the contrast is increased, so that the contrast cannot be maintained constant.

For example, for graph G10, when the illuminance of the ambient light is about 300 lx, the contrast is set to a fixed value X1. However, when the illuminance of the ambient light decreases to, for example, 100 lx, the contrast becomes X2 (>X1), so that the contrast cannot be kept at the initial value X1. In contrast, when the illuminance of the ambient light increases to, for example, 800 lx, the contrast becomes X3 (<X1), so that the contrast cannot also be kept at the initial value X1.

To solve such a problem, when the illuminance of the ambient light decreases to, for example, 100 lx, it is preferably to decrease the amount of current to be supplied to the LED 22 to reduce the luminance of the LED 22, thereby maintaining the contrast at a fixed value X1. In contrast, when the illuminance of the ambient light increases to, for example, 800 lx, it is preferably to increase the amount of current to be supplied to the LED 22 to increase the luminance of the LED 22, thereby maintaining the contrast at a fixed value X1.

Thus, even if the illuminance of the ambient light changes, this embodiment can maintain the contrast constant.

Specifically, when the contrast at the start of the liquid crystal device 100 is set to a default value (e.g., a fixed value X1), the luminance control circuit 24 acquires a table (e.g., a table on the contrast for graph G10) for setting the contrast of the liquid-crystal display panel 30 to the fixed value (e.g., the value X1) from the tables stored in the EEPROM 72 under the control of the MPU 81 so as to bring the contrast of the liquid-crystal display panel 30 to the fixed value (e.g., the value X1), and controls the luminance of the illuminating unit 20 on the basis of the table (e.g., for the value X1, the amount of current to be supplied to the LED 22 is set to A1). Thus, the contrast can be kept at the fixed value X1.

However, when the illuminance of the ambient light is decreased to, e.g., 100 lx, in this liquid crystal device 100, the luminance control circuit 24 acquires a table (e.g., a table on the contrast for graph G11) for setting the contrast of the liquid-crystal display panel 30 to a fixed value (e.g., a value X1) from the tables stored in the EEPROM 72 under the control of the MPU 81 so as to bring the contrast of the liquid-crystal display panel 30 to the fixed value (e.g., the value X1), and controls the luminance of the illuminating unit 20 on the basis of the table (e.g., for the value X1, the amount of current to be supplied to the LED 22 is set to A2 (<A1)). Thus, the contrast can be kept at the fixed value X1.

In contrast, when the illuminance of the ambient light is increased to, e.g., about 800 lx, the luminance control circuit 24 acquires a table (e.g., a table on the contrast for graph G12) for setting the contrast of the liquid-crystal display panel 30 to a fixed value (e.g., a value X1) from the tables stored in the EEPROM 72 under the control of the MPU 81 so as to bring the contrast of the liquid-crystal display panel 30 to the fixed value (e.g., the value X1), and controls the luminance of the illuminating unit 20 on the basis of the table (e.g., for the value X1, the amount of current to be supplied to the LED 22 is set to A3 (>A1)). Thus, the contrast can be kept at the fixed value X1.

Thus, even if the illuminance of the ambient light changes, this embodiment can maintain the contrast constant.

While this embodiment uses only three kinds of data in graphs G10, G11, and G12 to keep the contrast constant, the invention may be constructed so as to keep the contrast constant with higher accuracy using data more than the three kinds of data.

Method for Automatically Controlling the Light of Illuminating Unit for the Purpose of Controlling Color Reproduction Range Based on NTSC Standard Ratio The invention also allows the illuminating unit 20 to perform automatic light control of the illuminating unit 20 for the purpose of controlling the color reproduction range based on National Television System Committee (NTSC) standard ratio.

The color reproduction range of liquid crystal devices is generally expressed as an area ratio of the triangle formed by red (0.670, 0.330), green (0.210, 0.710), and blue (0.140, 0.080) in the chromaticity coordinates (x, y) in a chromaticity diagram of an XYZ color system to the NTSC standard ratio. For example, the color reproduction range of the liquid crystal device is expressed as an NTSC standard ratio of 90%.

When lights pass through the colored layers 6R, 6G, and 6B in the liquid crystal device 100, the lights exhibit red (R), green (G), and blue (B), respectively. However, if the illuminance of the ambient light changes, the tones of the R, G, and B change, correspondingly, thus making it difficult to realize a desired color reproduction range, e.g., an NTSC standard ratio of 90%. In other words, when the illuminance of the ambient light increases to increase the brightness of the display screen, the apparent hues of the R, G, and B lights that have passed through the colored layers 6R, 6G, and 6B are viewed light; on the other hand, when the illuminance of the ambient light decreases to decrease the brightness of the display screen, the apparent hues of the R, G, and B lights that have passed through the colored layers 6R, 6G; and 6B is viewed deep, thus making it difficult to realize a desired color reproduction range, e.g., an NTSC standard ratio of 90%.

Accordingly, in the method according to this embodiment, even when the illuminance of the ambient light changes, the color reproduction range relative to the NTSC standard is maintained at a predetermined ratio, e.g., an NTSC standard ratio of 90%, as in the automatic light control of an illuminating unit based on the contrast ratio. In this case, the contrast in ordinate of FIG. 10 is replaced with the NTSC standard ratio (%). Graph G10 in FIG. 10 shows the relationship between the logarithm of the illuminance of the ambient light and the color reproduction range based on the NTSC standard ratio of the liquid-crystal display panel 30 when the luminance of the illuminating unit 20, that is, the amount of current to be supplied to the LED 22 is set to a value A1; graph G11 shows the relationship between the logarithm of the illuminance of the ambient light and the color reproduction range based on the NTSC standard ratio of the liquid-crystal display panel 30 when the luminance of the illuminating unit 20 is set to a value A2 (<A1); and graph G12 shows the relationship between the logarithm of the illuminance of the ambient light and the color reproduction range based on the NTSC standard ratio of the liquid-crystal display panel 30 when the luminance of the illuminating unit 20 is set to a value A3 (>A1). The graphs are stored in the EEPROM 72 of FIG. 5 as a plurality of tables.

Specifically, the luminance control circuit 24 acquires a table for setting the color reproduction range of the liquid-crystal display panel 30 to a color reproduction range based on the NTSC standard ratio, e.g., 90%, from the tables (for graphs G10, G11, and G12) stored in the EEPROM 72 so as to bring the color reproduction range of the liquid-crystal display panel 30 to a color reproduction range based on the NTSC standard ratio, e.g., 90%, and controls the luminance of the illuminating unit 20 on the basis of the table. Thus, even if the illuminance of the ambient light changes, the color reproduction range of the liquid-crystal display panel 30 can be kept in the color reproduction range based on the predetermined NTSC standard ratio, e.g., 90%.

Method for Automatically Controlling the Light of Illuminating Unit Including RGB Light Sources Referring to FIGS. 11 and 12, a method for automatically controlling the light of an illuminating unit having LEDs that emits three or more colors of light as light sources will be described.

Figure 11:
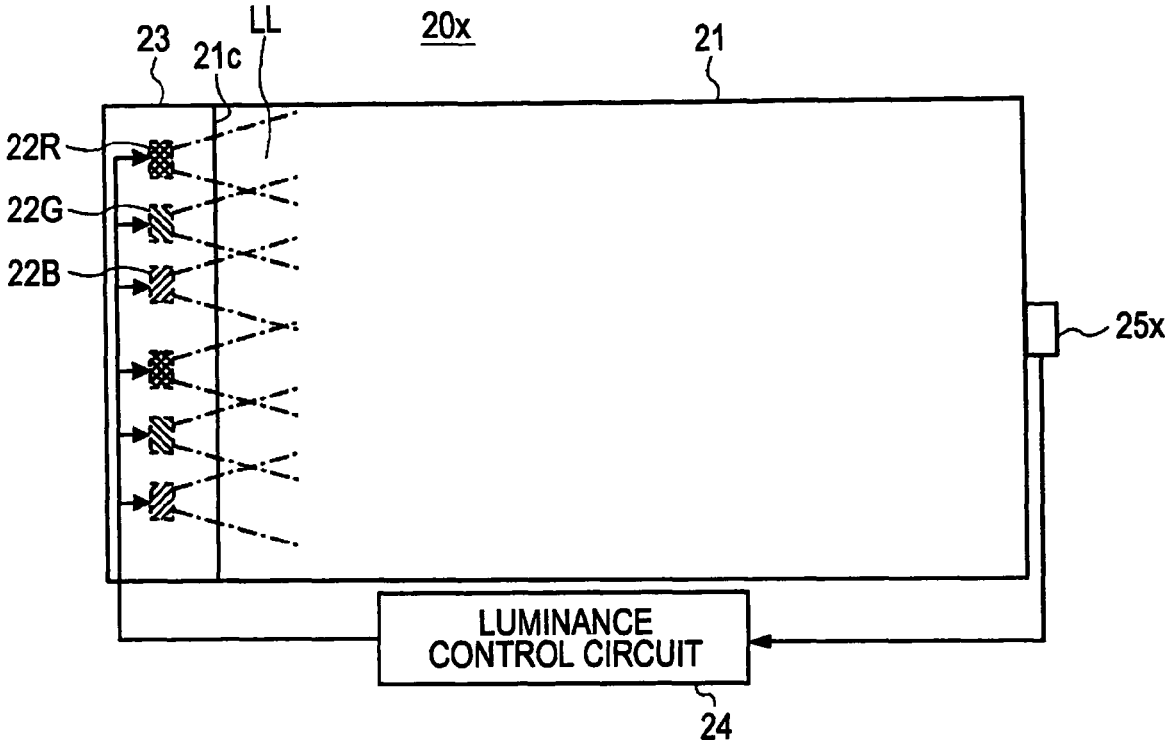
FIG. 11 is a plan view of an illuminating unit including an RGB light source.

FIG. 11 is a plan view of an illuminating unit 20*x* including red (R), green (G), and blue (B) LEDs. In FIG. 11, the same components as those of the illuminating unit 20 in FIG. 2 are denoted by the same reference numerals and descriptions thereof will be omitted.

The illuminating unit 20*x* includes the optical waveguide 21 and the light source 23.

The light source 23 includes a red LED 22R, a green LED 22G, and a blue LED 22B which are point sources of light. The light source 23 emits light LL onto the light-incident-end face 21*c* of the optical waveguide 21. The RGB LEDs 22R, 22G; and 22B emit light by the passage of current. The light LL emitted from the light source 23 becomes white by the mixture of lights from the RGB LEDs 22R, 22G, and 22B. Specifically, the currents supplied to the RGB LEDs 22R, 22G, and 22B are constant currents or pulse currents. When the constant currents or the width of the pulse currents to be supplied to the RGB LEDs 22R, 22G, and 22B are increased, the luminances of the lights emitted from the RGB LEDs 22R, 22G, and 22B are increased; when the constant currents or the width of the pulse currents to be supplied to the RGB LEDs 22R, 22G, and 22B are decreased, the luminances of the lights emitted from the RGB LEDs 22R, 22G, and 22B are decreased. That is, the luminances of the lights emitted from the RGB LEDs 22R, 22G, and 22B change as the constant currents or the width of the pulse current change.

The LEDs 22R, 22G, and 22B are electrically connected to the luminance control circuit 24. The luminance control circuit 24 is electrically connected to a photosensor 25*x* disposed in the position of the optical waveguide 21 at which the white light or the mixture of the lights emitted from the LEDs 22R, 22G, and 22B can be sensed (in this embodiment, the end face of the optical waveguide 21 opposite to the LED 22). The photosensor 25*x* detects the white light or the mixture of the lights emitted from the LEDs 22R, 22G, and 22B, and conducts a spectral analysis of it to thereby calculate the luminances [$cd \cdot m^{-2}$] of the lights from the LEDs 22R, 22G, and 22B, and outputs voltages corresponding to the luminances to the luminance control circuit 24. The luminance control circuit 24 changes the luminances of the lights of the LEDs 22R, 22G, and 22B according to the electric signals corresponding to the voltages.

Figure 12:
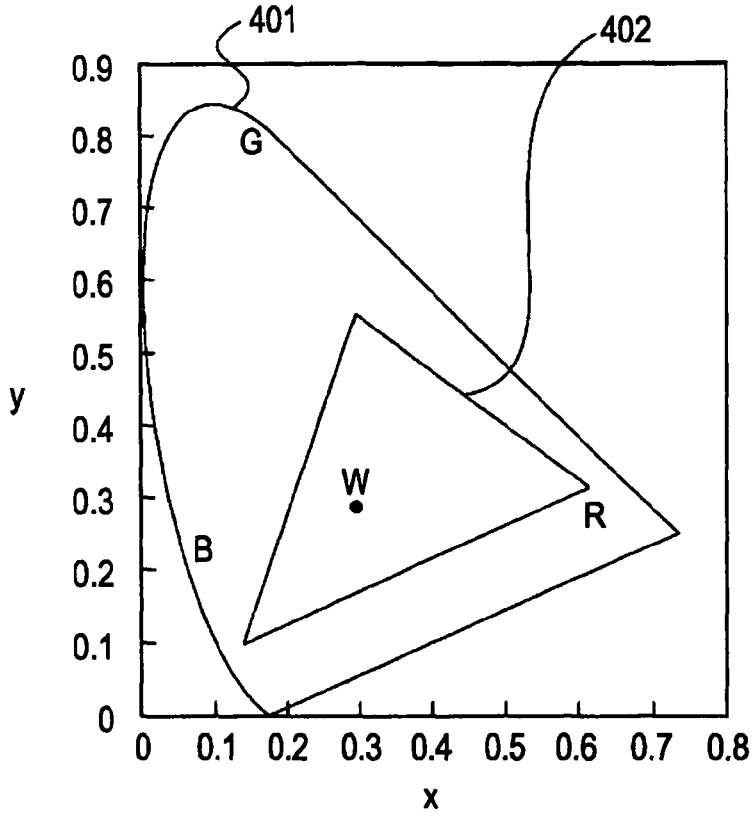
FIG. 12 is a CIE chromaticity diagram of color reproduction ranges.

FIG. 12 is a CIE chromaticity diagram of color reproduction ranges of the liquid crystal device 100 according to the embodiment. In FIG. 12, a color reproduction range 401 is based on the wavelength sensing characteristic of human eyes, which shows a color reproduction range for human eyes to see. A color reproduction range 402 indicated by a triangle solid line is achieved by the liquid crystal device 100 having colored layers of only RGB three colors according to this embodiment. Point W indicates a white point on the liquid-crystal display panel 30 when white light or the mixture of lights from the RGB LEDs 22 with the lighting time at zero illuminates the liquid-crystal display panel 30.

With the liquid crystal device 100, the constant currents or the widths of the pulse currents to be supplied to the RGB LEDs 22R, 22G, and 22B are determined so that the white point is set to point W. However, aged deterioration varies among the RGB LEDs 22R, 22G, and 22B. Therefore, even if appropriate currents are applied, the white point deviates from point W by the aged deterioration. Thus, the light emitted from the illuminating unit toward the liquid-crystal display panel 30 becomes tinted white into imbalanced white.

Therefore, in this embodiment, the white light or the mixture of lights emitted from the RGB LEDs 22R, 22G, and 22B is sensed by the photosensor 25*x* and subjected to spectral analysis always or regularly to thereby calculate the luminances of the lights from the LEDs 22R, 22G, and 22B, and voltages corresponding to the calculated luminances are output to the luminance control circuit 24. Then, the luminance control circuit 24 controls the currents to be supplied to the LEDs 22R, 22G, and 22B according to the electric signals corresponding to the supplied voltages to change the luminances so that the white point is set to, e.g., point W. The color matching allows the white balance to be regulated to keep the white point to, e.g., point W. This enhances the color reproducibility.

The invention thus allows the optimum display quality to be automatically maintained under various environments by the above-described various light control methods for an illuminating unit.

Applications

It is preferable to execute (i) the method for automatically controlling the light of the illuminating unit, (ii) the method for automatically controlling the light of the illuminating unit for the purpose of controlling the contrast, (iii) the method for automatically controlling the light of the illuminating unit for the purpose of controlling the color reproduction range based on an NTSC standard ratio, and (iv) the method for automatically controlling the light of the illuminating unit including the RGB light source, when the voltages output from the photosensor 25 or the photosensor 25*x* are sampled a plurality of times, wherein when the cumulative total divided by the number of samplings exceeds a predetermined threshold. This reduces an influence of disturbances, allowing automatic light control of the illuminating unit at high accuracy.

Modifications

While the foregoing embodiments have one photosensor 25 or photosensor 25*x*, those are merely examples; the number of the photosensor 25 or the photosensor 25*x* may be plural. This provides higher-accuracy automatic light control.

While the invention is applied to a liquid crystal device including a TFD element as an example of a two-terminal nonlinear element, the invention is not limited to that. The invention may be applied to three-terminal element typified by an LTPS TFT element, a P-Si TFT element, or α-Si TFT element.

It is to be understood that various changes and modifications may be made without departing from the spirit and scope of the invention.

Electronic Devices

Figure 13A:
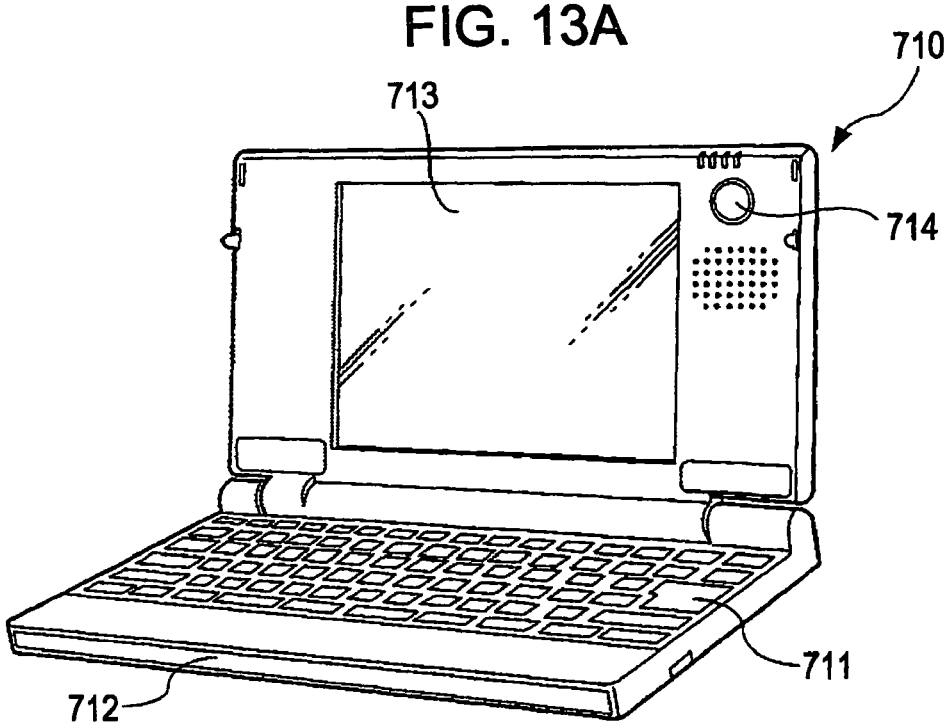
FIG. 13A is a perspective view of a personal computer incorporating the liquid crystal device according to the embodiment.
Figure 13B:
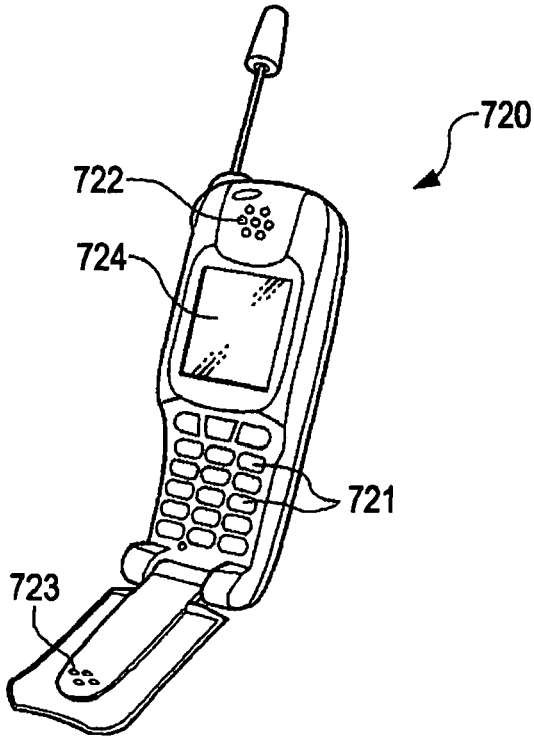
FIG. 13B is a perspective view of a mobile phone incorporating the liquid crystal device according to the embodiment.

Referring to FIGS. 13A and 13B, concrete examples of electronic devices that can incorporate the liquid crystal device 100 according to the embodiments will be described.

An example in which the liquid crystal device 100 is applied to the display of a portable personal computer (a notebook computer), denoted at 710, will be described. FIG. 13A is a perspective view of the personal computer 710. The personal computer 710 includes a main body 712 having a keyboard 711, a display 713 incorporating the liquid crystal device 100 according to the embodiments of the invention, and a power switch 714 for turning on/off the power source of the personal computer 710. The above-described methods for automatically controlling the light of the illuminating unit 20 can also be applied to the light-emitting section of the personal computer 710, such as the power switch 714. Thus, the luminance of the light-emitting section can be controlled so as to provide brightness suitable for humans' visual sense, and the power saving of the light-emitting section and the personal computer 710 can be achieved.

An example in which the liquid crystal device 100 according to the embodiments is applied to the display of a portable phone, denoted at 720, will be described. FIG. 13B is a perspective view of the portable phone 720. The portable phone 720 includes a plurality of operation buttons 721, a receiver 722, a transmitter 723, and a display 724 incorporating the liquid crystal device 100.

The methods for automatically controlling the light of the illuminating unit 20 can also be applied to the light-emitting section of the portable phone 720, such as the operation buttons 721. Thus, the luminance of the light-emitting section can be controlled so as to provide brightness suitable for humans' visual sense, and the power saving of the light-emitting section and the portable phone 720 can be achieved.

For a mobile phone having a main liquid-crystal display panel and an auxiliary liquid-crystal display panel, the methods for automatically controlling the light of an illuminating unit can also be applied to the illuminating units of both the main and auxiliary liquid-crystal display panels. This allows power saving of the mobile phone.

In addition to the personal computer shown in FIG. 13A and the mobile phone shown in FIG. 13B, electronic devices that can incorporate the liquid crystal device 100 include liquid crystal televisions, viewfinder monitor-direct-view video tape recorders, car navigation systems, pagers, electronic notebooks, electronic calculators, word processors, work stations, TV phones, POS terminals, and digital still cameras.

What is claimed is:

1. An electrooptic device comprising:

a display panel;

an illuminating unit that emits light onto the display panel;

an ambient-light measuring unit that measures an illuminance of ambient light;

a luminance control unit including a light control profile for obtaining an optimum surface luminance of the display panel, the luminance control unit obtaining the optimum surface luminance on the basis of the measured illuminance of the ambient light using the light control profile, and controlling the luminance of the light to be emitted from the illuminating unit to provide the display panel with the optimum surface luminance, wherein:

the light control profile is set such that light-emitting brightness of the illuminating unit becomes large when irradiation of a surrounding environment light is large, and the light-emitting brightness of the illuminating unit becomes small when irradiation of the surrounding environment light is small, and the light control profile has a relationship in which the optimum surface luminance forms a concave quadratic curve with respect to a logarithm of the illuminance of the ambient light;

a display-mode switching unit that switches the display panel to a transmission display mode when the illuminance of the ambient light measured by the ambient-light measuring unit is lower than a predetermined illuminance, and switches the display panel to a reflection display mode when the illuminance of the ambient light is higher than the predetermined illuminance; and a storage unit that stores a gamma value for a transmission display for the transmission display mode and a gamma value for a reflection display for the reflection display mode as a plurality of tables;

wherein when the display panel is switched to the transmission display mode by the display-mode switching unit, the gamma value for the transmission display is obtained from the plurality of tables stored in the storage unit, and the gamma value for the transmission display is applied; and when the display panel is switched to the reflection display mode by the display-mode switching unit, the gamma value for the reflection display is obtained from the plurality of tables stored in the storage unit, and the gamma value for the reflection display is applied.

2. The electrooptic device according to claim 1, wherein:

when the illuminance of the ambient light measured by the ambient-light measuring unit is 1,000 lx or lower, the display-mode switching unit switches the display panel to the transmission display mode, and when the illuminance of the ambient light is higher than 1,000 lx, the display-mode switching unit switches the display panel to the reflection display mode; and the predetermined illuminance is 1,000 lx.

3. The electrooptic device according to claim 1, wherein:

the storage unit includes a plurality of tables in which the relationship between the logarithm of the illuminance of the ambient light and a contrast of the display panel is stored for each luminance of the light of the illuminating unit; and the luminance control unit obtains a table for setting the display panel to a predetermined contrast from the plurality of tables stored in the storage unit so as to provide the display panel with the predetermined contrast, and controls the luminance of the light of the illuminating unit according to the table.

4. The electrooptic device according to claim 1, wherein:

the storage unit has a plurality of tables in which a relationship between the logarithm of the illuminance of the ambient light and a color reproduction range based on an NTSC standard ratio of the display panel is stored for each luminance of the light of the illuminating unit; and the luminance control unit obtains a table for setting the display panel to a predetermined color reproduction range based on an NTSC standard ratio from the plurality of tables stored in the storage unit so as to provide the display panel with the color reproduction range based on the NTSC standard ratio, and controls the luminance of the light of the illuminating unit according to the table.

5. The electrooptic device according to claim 1, wherein:

the illuminating unit includes a plurality of light sources having semiconductor light-emitting elements that emit three or more colors of light, respectively;

the electrooptic device further includes a photosensor disposed in the position to detect mixed light generated by the plurality of light sources of the illuminating unit, the photosensor detecting the mixed light and conducting spectral analysis of it to thereby calculate luminances of the light sources; and the luminance control unit includes a driving unit that supplies current to the plurality of light sources, and regulates the white balance of the display panel by controlling a current to be supplied to a light source that emits a predetermined color of light out of the light sources.

6. The electrooptic device according to claim 1, wherein provided that the illuminance of the ambient light when the luminance of the light incident on the display panel and reflected in the display panel and exits from the display panel and the luminance of the light emitted from the illuminating unit and transmitted through the display panel are equal to each other is a maximum illuminance environment, the optimum surface luminance becomes a maximum under the maximum illuminance environment, and a maximum value of the optimum surface luminance becomes 90% or more of a maximum luminance of the display panel.

7. The electrooptic device according to claim 1, wherein the maximum value of the optimum surface luminance is the maximum luminance of the display panel.

8. The electrooptic device according to claim 1, wherein provided that the illuminance of the ambient light when the luminances of the reflected light and transmitted light from the display panel are equal to each other is 8,000 lx or higher, the maximum illuminance environment is set to 8,000 lx.

9. The electrooptic device according to claim 1, wherein when the illuminance of the ambient light measured by the ambient-light measuring unit becomes higher than the maximum illuminance environment, the luminance control unit stops the light emission to the display panel by the illuminating unit.

10. An electronic device comprising an electrooptic device according to claim 1 applied to a display.

11. The electronic device according to claim 10, comprising:

a light-emitting section other than the illuminating unit;

wherein the luminance control unit has a light control profile for obtaining the optimum surface luminance of the light-emitting section, the luminance control unit obtaining the optimum surface luminance on the basis of the illuminance of the ambient light measured by the ambient-light measuring unit using the light control profile, and controlling a luminance of the light-emitting section to provide the light-emitting section with the optimum surface luminance.

12. The electrooptic device according to claim 1, wherein, when the measured illuminance of the ambient light reaches a predetermined value, then a maximum surface luminance is maintained when the measured illuminance of the ambient light is above the predetermined value.

13. A driving circuit that automatically controls a light of an illuminating unit that emits light onto a display panel, the driving circuit comprising:

an ambient-light measuring unit that measures an illuminance of ambient light;

a luminance control unit including a light control profile for obtaining an optimum surface luminance of the display panel, the luminance control unit obtaining the optimum surface luminance on the basis of the measured illuminance of the ambient light using the light control profile, and controlling the luminance of the illuminating unit to provide the display panel with the optimum surface luminance, wherein:

the light control profile is set such that light-emitting brightness of the illuminating unit becomes large when irradiation of a surrounding environment light is large, and the light-emitting brightness of the illuminating unit becomes small when irradiation of the surrounding environment light is small, and the light control profile has a relationship in which the optimum surface luminance forms a concave quadratic curve with respect to a logarithm of the illuminance of the ambient light;

a display-mode switching unit that switches the display panel to a transmission display mode when the illuminance of the ambient light measured by the ambient-light measuring unit is lower than a predetermined illuminance, and switches the display panel to a reflection display mode when the illuminance of the ambient light is higher than the predetermined illuminance; and a storage unit that stores a gamma value for a transmission display for the transmission display mode and a gamma value for a reflection display for the reflection display mode as a plurality of tables;

wherein when the display panel is switched to the transmission display mode by the display-mode switching unit, the gamma value for the transmission display is obtained from the plurality of tables stored in the storage unit, and the gamma value for the transmission display is applied; and when the display panel is switched to the reflection display mode by the display-mode switching unit, the gamma value for the reflection display is obtained from the plurality of tables stored in the storage unit, and the gamma value for the reflection display is applied.

* * * * *